US008568191B2

(12) United States Patent
Rehkemper et al.

(10) Patent No.: US 8,568,191 B2
(45) Date of Patent: Oct. 29, 2013

(54) SPINNING TOY VEHICLE AND GAME

(71) Applicant: Rehco, LLC, Chicago, IL (US)

(72) Inventors: Jeffrey Rehkemper, Chicago, IL (US); Ryan Kratz, Oak Park, IL (US); Phillip H Fensel, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 13/665,023

(22) Filed: Oct. 31, 2012

(65) Prior Publication Data

US 2013/0056929 A1 Mar. 7, 2013

Related U.S. Application Data

(63) Continuation-in-part of application No. 13/034,834, filed on Feb. 25, 2011.

(60) Provisional application No. 61/307,904, filed on Feb. 25, 2010.

(51) Int. Cl.

| | |
|---|---|
| ***A63H 1/02*** | (2006.01) |
| ***A63H 17/00*** | (2006.01) |
| ***A63H 29/24*** | (2006.01) |
| ***A63F 9/16*** | (2006.01) |
| *A63H 17/26* | (2006.01) |

(52) U.S. Cl.

CPC ..... *A63H 1/02* (2013.01); *A63H 17/008* (2013.01); *A63H 17/262* (2013.01); *A63H 29/24* (2013.01); *A63F 9/16* (2013.01)

USPC ..... 446/259; 446/71; 446/236; 446/237; 446/238; 446/256; 446/264; 446/376; 446/429; 446/465; 446/470; 273/108; 273/129 R

(58) Field of Classification Search

CPC ..... A63H 1/02; A63H 17/008; A63H 17/262; A63H 29/24; A63F 9/16

USPC ..... 446/71, 236, 237, 238, 256, 259, 264, 446/376, 429, 465, 470; 273/108, 129 R

See application file for complete search history.

(56) References Cited

U.S. PATENT DOCUMENTS 3,605,631 A * 9/1971 See et al. ..... 46/429
3,628,285 A * 12/1971 Murakami ..... 446/233

(Continued)

*Primary Examiner* — Gene Kim
*Assistant Examiner* — Alexander Niconovich
(74) *Attorney, Agent, or Firm* — Adam K. Sacharoff

(57) ABSTRACT

A toy vehicle which may have the capability to raise and lower a spin mechanism within the vehicle to lift the vehicle up off of a surface and spin the vehicle in a top-like manner when the spin mechanism is charged. The vehicle may further include a chassis with a cavity to house the spin mechanism and a release mechanism to direct the spin mechanism to lower a spin shaft below wheels on the vehicle. Energy may be generated in a power drive system and transferred to the vehicle via a transfer gear in the spin mechanism. Another embodiment of the vehicle may also transforms between multiple configurations, including a spinning top, and utilizes a launch mechanism to spin the vehicle in a top-like manner. This embodiment may further include a sliding front segment, a sliding rear segment, two sliding side segments and a receiving cavity. When the sliding front segment and rear segment move toward one another, the two side segments are pushed outward and direct a spin shaft downward to extend below the vehicle. Energy generated and stored in the power drive system may be transferred to the vehicle via the rotation of the launch shaft to spin the vehicle on the spin shaft.

21 Claims, 27 Drawing Sheets

(56) References Cited

U.S. PATENT DOCUMENTS

| | | | | | |
|---|---|---|---|---|---|
| 4,156,986 | A * | 6/1979 | Kupperman et al. | 446/462 |
| 4,193,597 | A * | 3/1980 | Ogawa | 273/405 |
| 4,463,518 | A * | 8/1984 | Smathers et al. | 446/237 |
| 4,464,860 | A * | 8/1984 | Onodera | 446/491 |
| 4,737,135 | A * | 4/1988 | Johnson et al. | 446/430 |
| 4,846,758 | A * | 7/1989 | Chou | 446/437 |
| 4,982,961 | A * | 1/1991 | Ichimura | 273/109 |
| 5,026,057 | A * | 6/1991 | Watford | 273/108.1 |
| 5,518,437 | A * | 5/1996 | Nonaka et al. | 446/259 |
| 5,542,872 | A * | 8/1996 | Ho | 446/440 |
| 5,667,421 | A * | 9/1997 | Uetake | 446/470 |
| 5,735,727 | A * | 4/1998 | Tsai | 446/462 |
| 5,759,083 | A * | 6/1998 | Polumbaum et al. | 446/435 |
| 5,836,804 | A * | 11/1998 | Tsai | 446/440 |
| 5,860,846 | A * | 1/1999 | Uetake | 446/470 |
| 5,951,363 | A * | 9/1999 | Uetake | 446/470 |
| 6,071,173 | A * | 6/2000 | Kelley | 446/465 |
| 6,394,876 | B1 * | 5/2002 | Ishimoto | 446/428 |
| 6,530,817 | B1 * | 3/2003 | Winslow et al. | 446/256 |
| 6,743,070 | B1 * | 6/2004 | Lin | 446/256 |
| 6,805,609 | B1 * | 10/2004 | Paukert et al. | 446/429 |
| 6,905,389 | B2 * | 6/2005 | Matsukawa | 446/256 |
| 6,926,581 | B2 * | 8/2005 | Lynders et al. | 446/466 |
| 7,063,589 | B2 * | 6/2006 | Matsukawa et al. | 446/256 |
| 7,217,170 | B2 * | 5/2007 | Moll et al. | 446/164 |
| 7,427,225 | B2 * | 9/2008 | Matsukawa et al. | 446/256 |
| 7,740,518 | B2 * | 6/2010 | Elliott | 446/256 |
| 7,815,486 | B2 * | 10/2010 | Bernstein et al. | 446/429 |
| 7,950,979 | B2 * | 5/2011 | Barthold | 446/470 |
| 8,011,992 | B2 * | 9/2011 | Ejima | 446/93 |
| 8,066,543 | B2 * | 11/2011 | Kitamura et al. | 446/256 |
| 8,083,566 | B2 * | 12/2011 | Finlan | 446/259 |
| 8,210,895 | B2 * | 7/2012 | Bertrand et al. | 446/259 |
| 2009/0075559 | A1 * | 3/2009 | Barthold | 446/470 |
| 2011/0256794 | A1 * | 10/2011 | Horikoshi et al. | 446/259 |
| 2011/0256796 | A1 * | 10/2011 | Ujita et al. | 446/264 |

* cited by examiner

OK TO ENTER: /A.N./

OK TO ENTER: /A.N./

SPINNING TOY VEHICLE AND GAME

CROSS REFERENCE TO RELATED APPLICATION

The present application is a continuation in part of U.S. application Ser. No. 13/034,834 filed on Feb. 25, 2011 which claims priority to U.S. Provisional Application 61/307,904 filed on Feb. 25, 2010.

FIELD OF THE INVENTION

The illustrative embodiments relate to a toy vehicle, and in particular to a toy vehicle with the capability to raise and lower a spin mechanism within the vehicle to lift the vehicle up off of a surface and spin the vehicle in a top-like manner when the spin mechanism is charged and may further be incorporated with a method of game play. An illustrative embodiment of the vehicle may also transforms between multiple configurations, including a spinning top, and utilizes a launch mechanism to spin the vehicle in a top-like manner which may further be incorporated into a method of game play.

BACKGROUND OF THE INVENTION

There have been numerous varieties of children's toys that are non-interactive and interactive. A continual need for improvements in or additions to play along with improvements in mechanics provide for new arrangements which improve, create or change the play and interaction between a child and the toy. Numerous other advantages and features of the invention become readily apparent from the following detailed description of the invention and embodiments thereof and from the accompanying drawings.

SUMMARY OF THE INVENTION

In one or more illustrative embodiments there may be provided a vehicle with spinning capabilities which may include a chassis with a cavity to receive a spin mechanism. At least two wheels may be rotatably attached to the chassis and the spin mechanism may further include a flywheel housing, a flywheel with a transfer gear, a spin shaft extending from the center of the flywheel and a clutch to engage to the chassis and flywheel to transfer energy from the flywheel to the chassis. The vehicle may also include a capability to raise and lower the spin mechanism within the cavity between a raised position and lowered position where the lower position may further be defined by the spin shaft lowering to lift the vehicle off of a surface, and such that the clutch engages the flywheel and chassis to spin simultaneously on the spin shaft when the flywheel is energized. Optionally, only the spin shaft may move up and down within the spin mechanism. The capability to raise and lower the spin mechanism may include a trigger for activation. An energy generator may be in communication with the transfer gear such that energy transferred from the energy generator spins the flywheel and spin shaft via the transfer gear, a first activation of the trigger lowers the flywheel and spin shaft to lift the vehicle off of the surface and engages the clutch to simultaneously spin the flywheel and chassis on the spin shaft.

In another illustrative embodiment there may be provided a transforming vehicle and launch system which may include a vehicle with a chassis, a sliding front segment, a sliding rear segment, two sliding side segments and a capability to transform between multiple configurations including a first configuration and a second configuration. Movement of the front segment and rear segment toward one another may push the two sliding side segments outward to further define the second configuration. The chassis may include at least two wheels rotatably attached thereto and a cavity to receive a spin mechanism. The spin mechanism may include a flywheel housing, a flywheel with a transfer gear, a spin shaft extending from the center of the flywheel and a friction clutch to transfer energy from the flywheel to the flywheel housing and chassis. The vehicle may further include a capability to raise and lower the spin mechanism within the cavity in accordance with the first configuration and the second configuration, respectively, where the second configuration may further be defined by the spin shaft lowering to lift the vehicle off of a surface, and such that the friction clutch engages the chassis and flywheel to spin simultaneously when the flywheel is energized. A trigger may direct the spin mechanism to lower when the vehicle transforms from the first configuration to the second configuration. An energy generator may be in communication with the transfer gear to spin the flywheel and chassis when the friction clutch transfers energy from the flywheel to the chassis to spin the vehicle on the spin shaft in the second configuration.

In yet another illustrative embodiment there may be provided a method of playing a game which may include providing at least two vehicles where each vehicle may have spinning capabilities. The vehicles may further include a chassis, a spin mechanism with a spin shaft and a flywheel with a transfer gear. An energy generator may be in communication with the transfer gear to energize the flywheel when a friction clutch engages the spin mechanism and chassis. The vehicle may include a capability to raise and lower the spin mechanism between at least a first position and a second position where the second position may further be defined by the spin shaft lowering to lift the vehicle off of a surface, and such that the friction clutch engages the spin mechanism and chassis to spin simultaneously when the flywheel is energized. The method of playing a game may further provide an energy generator for each vehicle and direct each player of a plurality of players to select a vehicle and energy generator and set the respective spin mechanism to the first position. The method of playing a game may further direct each player to activate their energy generator to transfer energy to the spin mechanism via the transfer gear, lower the spin mechanism, and then launch the vehicles toward one another such that the vehicles collide and then award points to a player based on the results of the collision to determine a winner based on obtaining a predetermined number of points.

In yet another illustrative embodiment, there may be provided a vehicle with spinning capabilities which may include a chassis with a cavity to receive a spin mechanism and at least two wheels rotatably attached to the chassis. The spin mechanism may include a flywheel with a transfer gear. A spin shaft may extend through a center aperture of the flywheel, a center aperture of the transfer gear, and at least one aperture of the chassis. The vehicle may include a friction clutch to engage the flywheel and chassis to transfer energy to the chassis from the flywheel. The vehicle may include a capability to raise and lower the spin shaft between at least a raised position and a lowered position where the lowered position may further be defined by the spin shaft lowering to lift the vehicle off of a surface such that flywheel and chassis spin simultaneously when the flywheel is energized. A trigger may be included to direct spin shaft movement between the raised position and lowered position. An energy generator may be provided to communicate with the transfer gear such that energy transferred from the energy generator may rotate the transfer gear to spin the flywheel, and a where a first activation of the trigger may lower the spin shaft to the lowered position such that friction forces engage the flywheel and chassis to spin the vehicle on the spin shaft.

Numerous other advantages and features of the invention will become readily apparent from the following detailed description of the illustrative embodiment thereof, from the claims and from the accompanying drawings.

BRIEF DESCRIPTION OF THE DRAWINGS

A fuller understanding of the foregoing may be had by reference to the accompanying drawings, wherein.

DESCRIPTION OF THE EMBODIMENTS

Figure 1A:
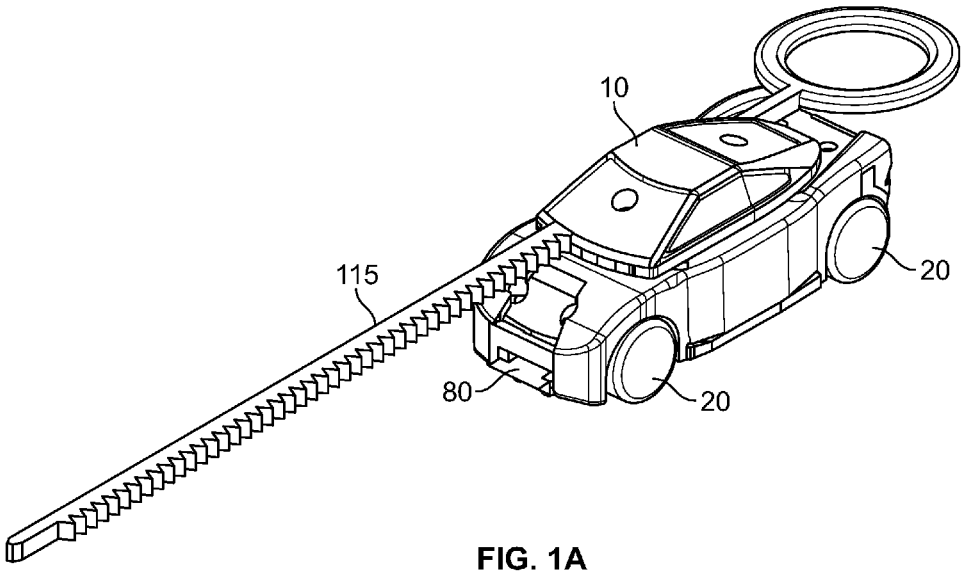
FIG. 1*a* is a perspective view of an illustrative vehicle and gear rack.
Figure 1B:
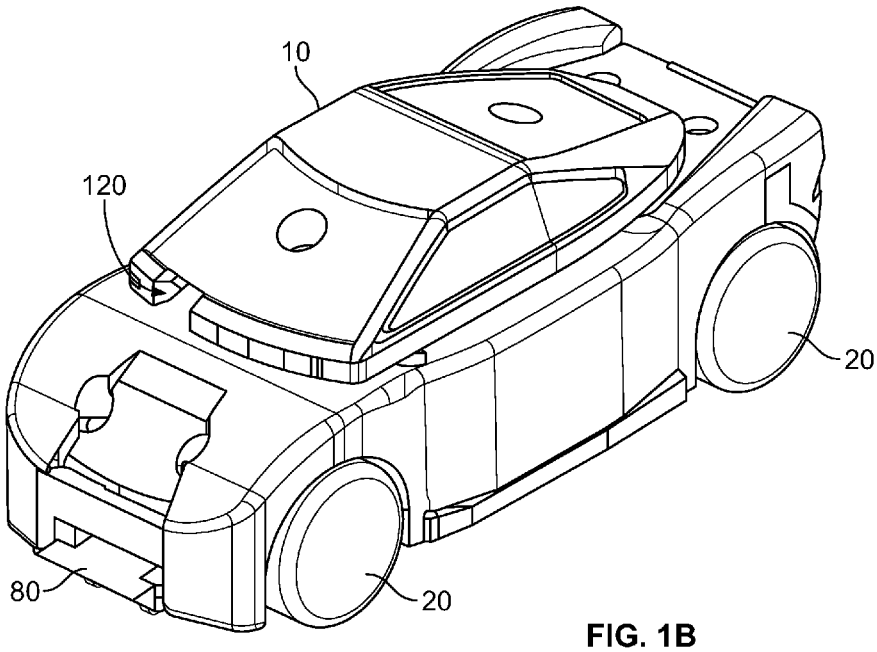
FIG. 1*b* is a perspective view of an illustrative vehicle.
Figure 1C:
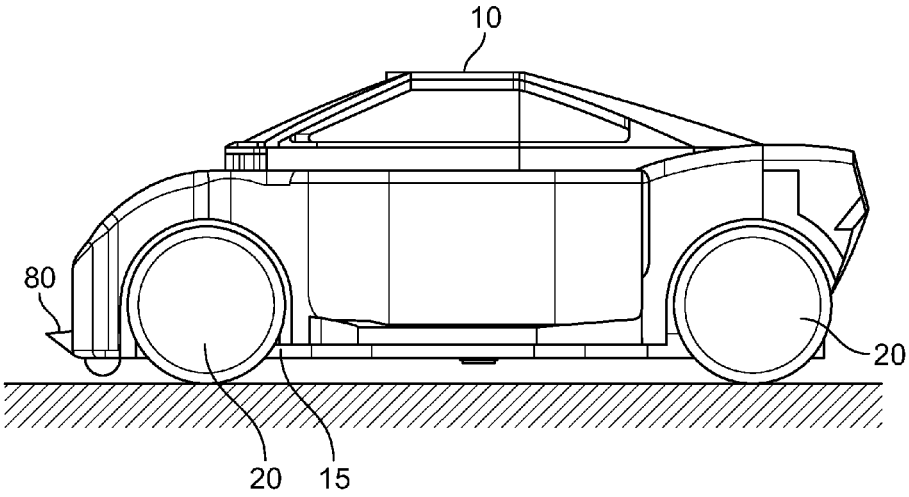
FIG. 1*c* is a side view of FIG. 1*b* where a spin shaft is in a raised position.
Figure 1D:
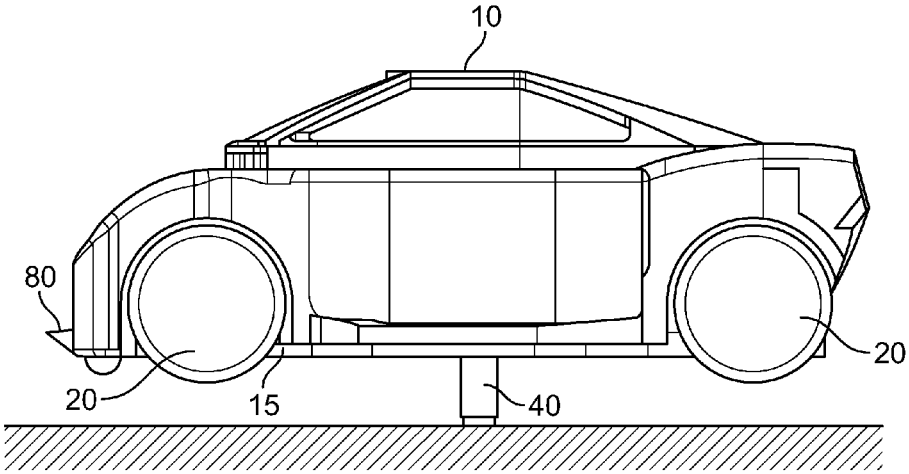
FIG. 1*d* is a side view of FIG. 1*b* where a spin shaft is in a lowered position.
Figure 2A:
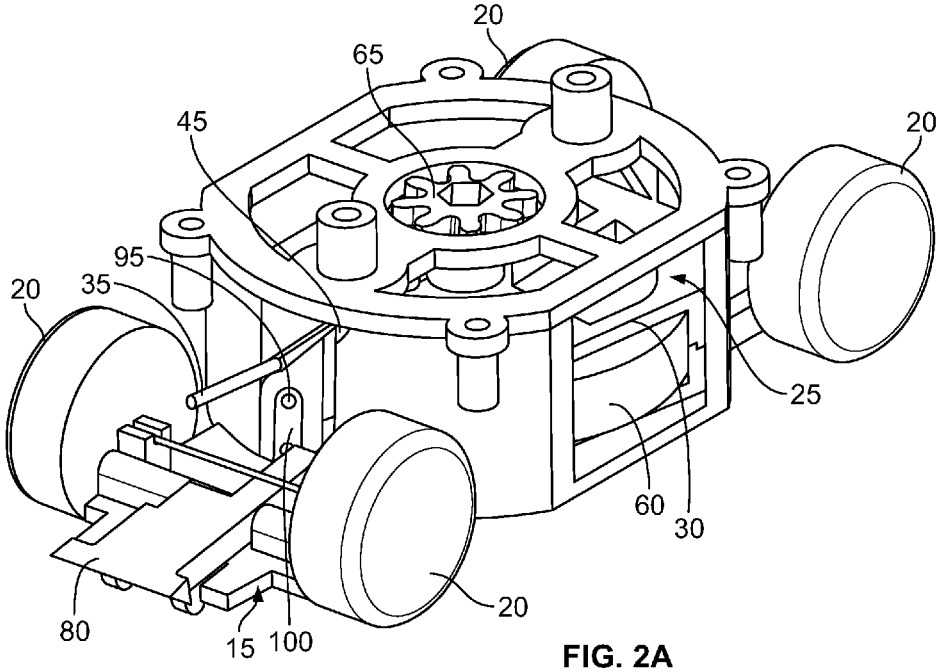
FIG. 2*a* is a perspective view of FIG. 1*b* where a portion of a vehicle housing is removed to show an illustrative chassis and internal mechanics of the vehicle.
Figure 2B:
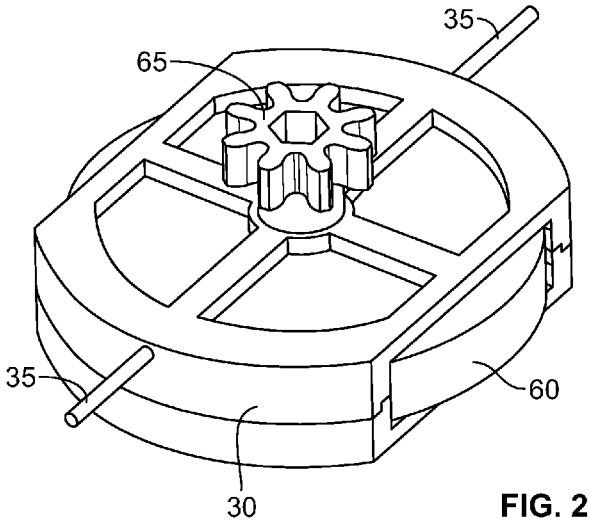
FIG. 2*b* is a perspective view of an illustrative portion of a spin mechanism included in the vehicle from FIG. 1*a;*
Figure 2C:
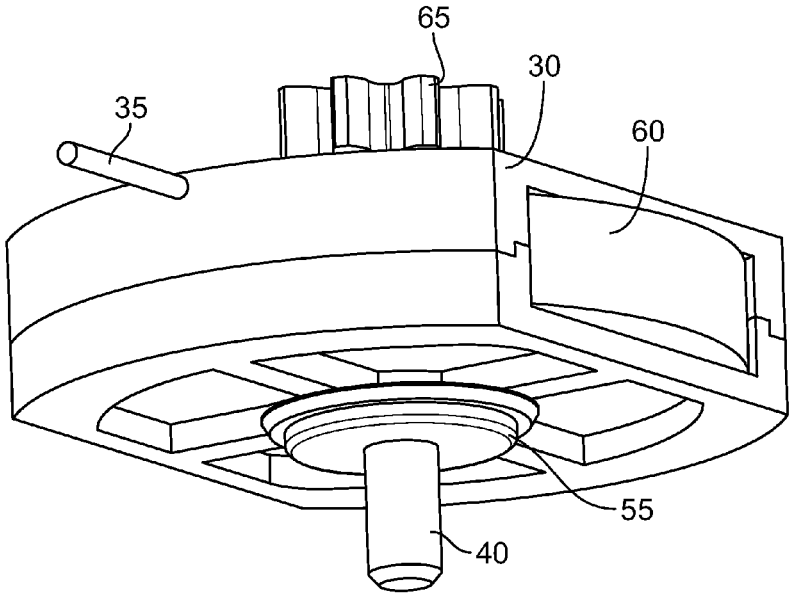
FIG. 2*c* is a lower perspective view of FIG. 2*b;*
Figure 2D:
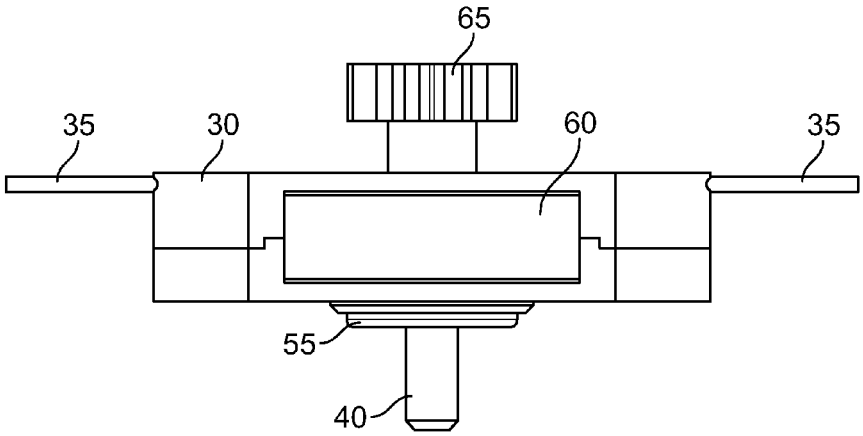
FIG. 2*d* is a side view of FIG. 2*b;*
Figure 2F:
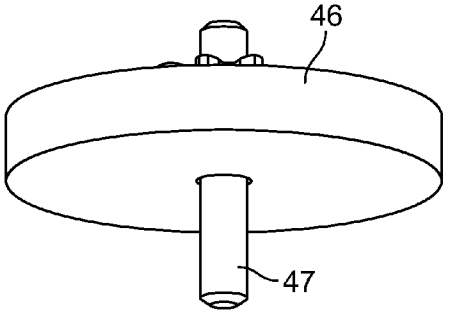
FIG. 2*f* is a lower perspective view of FIG. 2*e;*
Figure 2H:
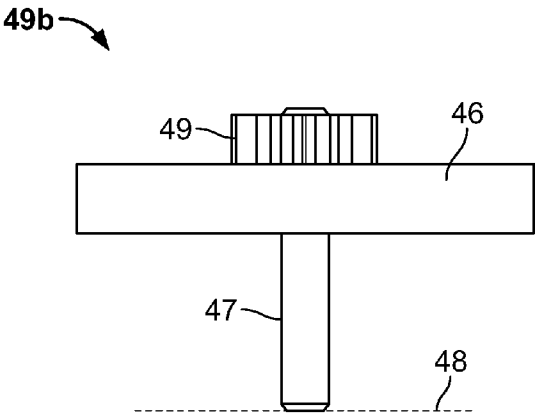
FIG. 2*h* is a side view of FIG. 2*e* where a spin shaft in a lowered position.
Figure 2E:
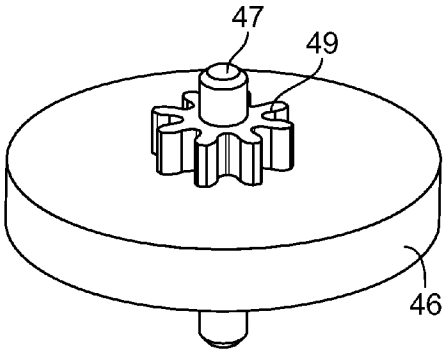
FIG. 2*e* is a perspective view of a portion of another spin mechanism which may be utilized with the vehicle from FIG. 1*a;*
Figure 2G:
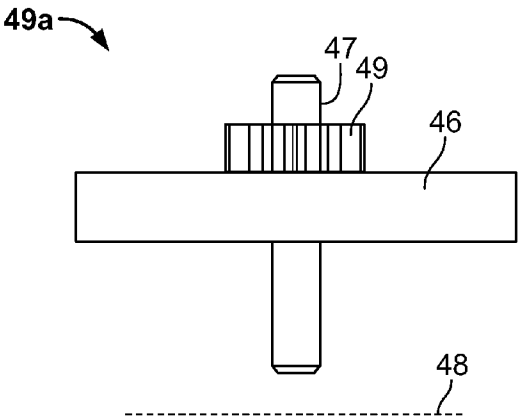
FIG. 2*g* is a side view of FIG. 2*e* where a spin shaft is in a raised position.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention, the claims or the embodiments illustrated.

Referring now to FIGS. 1*a*-1*d*, there is shown an exemplary vehicle 10 in accordance with an illustrative embodiment. The vehicle 10 may include a capability and/or means to raise and lower a spin mechanism within the vehicle 10 to lift the vehicle 10 off of a surface and spin the vehicle 10 in a top-like manner when the spin mechanism is charged. In this illustrative embodiment the vehicle 10 is in the form of a car, however, the vehicle 10 may take on several different forms, including but not limited to other types of cars, planes, or spaceships. A variety of forms may be used to incorporate the mechanics of the vehicle 10.

Now additionally referring to FIGS. 2*a*-2*d* and 3*a*-3*f*, the vehicle 10 includes an exemplary chassis 15 shown with four wheels 20 rotatably attached thereto, however it should be understood that the number of wheels and positioning may vary and not change the scope of the invention. The chassis 15 may include a cavity 25 to receive the spin mechanism including a flywheel housing 30 with two housing pins 35 extending therefrom and apertures to receive a spin shaft 40. The cavity 25 is sized to accommodate upward and downward movement of the flywheel housing 30 and includes two channels 45. An exemplary clutch includes a lower clutch cone 50 on the chassis 15 which may receive an upper clutch cone 55 (described below). In this illustrative embodiment a clutch includes the lower clutch cone 50 and upper clutch cone 55, however, alternative clutches may be used with the vehicle 10. For example and now referring to FIGS. 2*e*-2*h*, the vehicle 10 may utilize a friction clutch to transfer forces from another exemplary flywheel 46 to the chassis 15 and another exemplary spin shaft 47. In this illustrative example, a spin mechanism may include the flywheel 46 with a center aperture, and a transfer gear 49 fixed to the flywheel 46 with a center aperture in line with the flywheel 46 center aperture, and at least one aperture on the chassis 15. The spin shaft 47 may be positioned within the center apertures of the flywheel 46, transfer gear 49 and chassis 15 such that frictional forces may transfer from the flywheel 46 to the spin shaft 47 and chassis 15. The spin shaft 47 further may move up and down between position 49*a* and position 49*b*. In position 49*b*, the spin shaft 47 lifts the vehicle off of a surface 48. When the flywheel 46 is energized by rotating the transfer gear 49, forces are transferred from the surfaces of the flywheel 46 to the spin shaft 47 and chassis 15 when the spin shaft 47 is lowered to lift the vehicle off of the surface. As such, this illustrative spin mechanism may be included in the vehicle 10 such that the friction clutch transfers friction forces from the flywheel 46 to the chassis 15 to spin the vehicle 10 on the spin shaft 47.

Figure 3A:
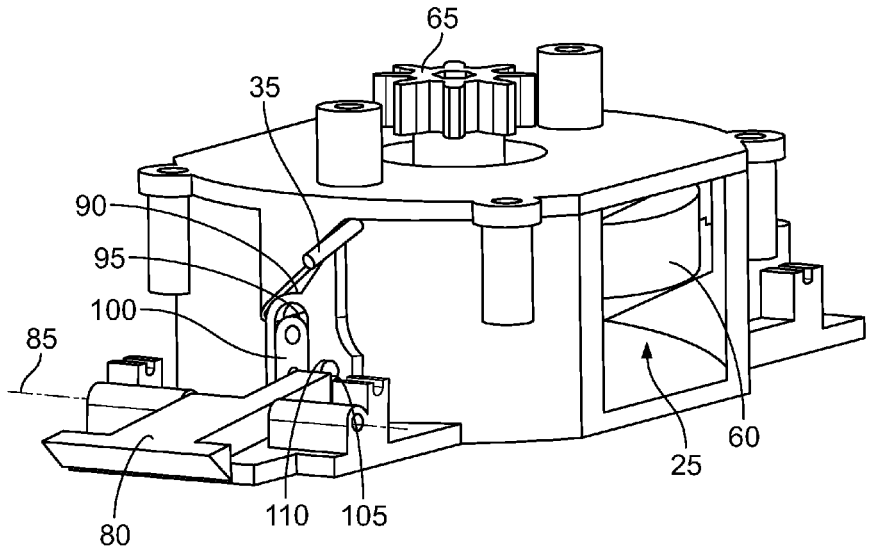
FIG. 3*a* is a perspective view of an illustrative vehicle chassis where a spin mechanism is in a raised position.
Figure 3B:
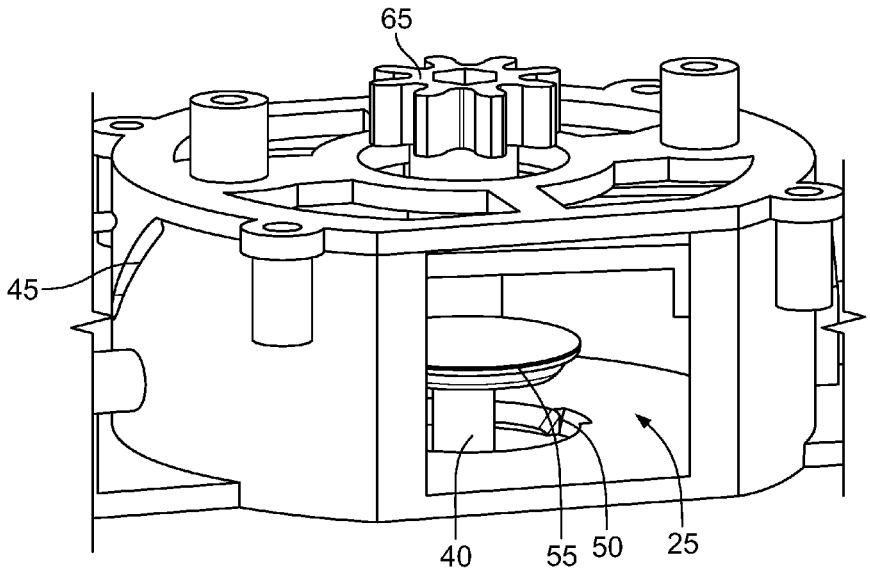
FIG. 3*b* is an enlarged perspective view of an illustrative chassis showing a clutch cone and clutch receiving cone.
Figure 3C:
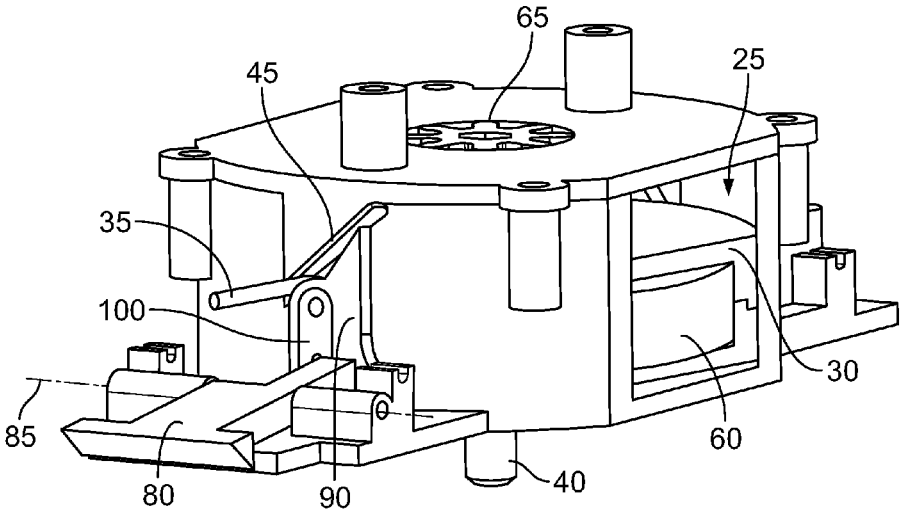
FIG. 3*c* is a perspective view of an illustrative vehicle chassis where the spin mechanism is in a lowered position.
Figure 3D:
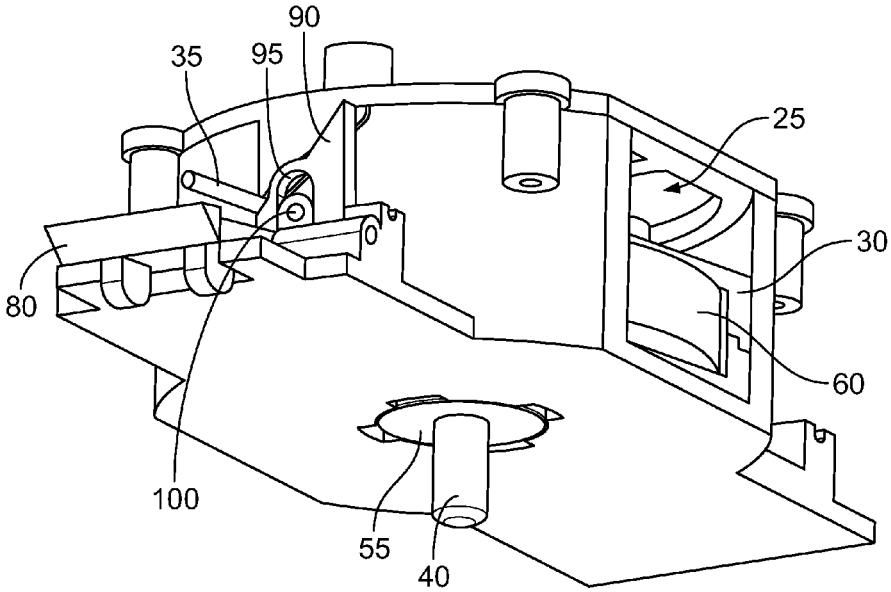
FIG. 3*d* is a lower perspective view of FIG. 3*c;*
Figure 3E:
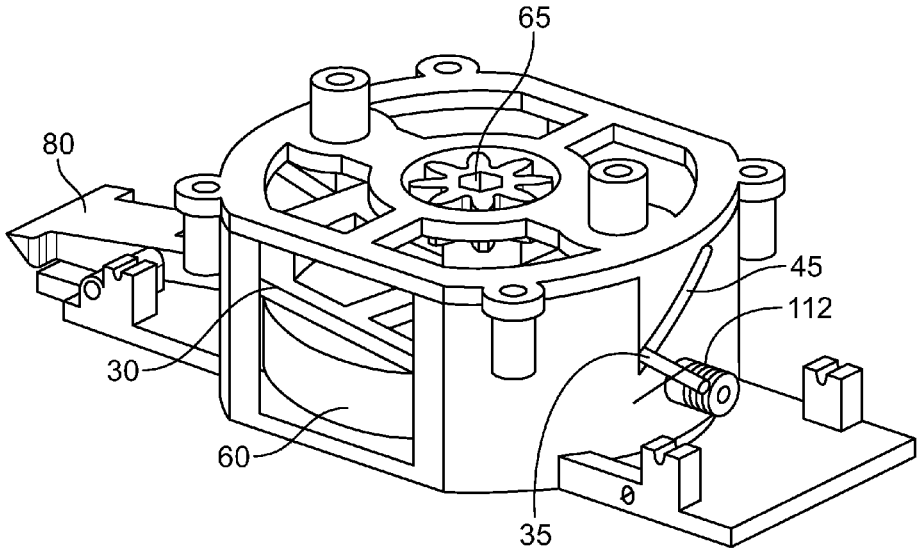
FIG. 3*e* is a rear perspective view of FIG. 3*c;*
Figure 3F:
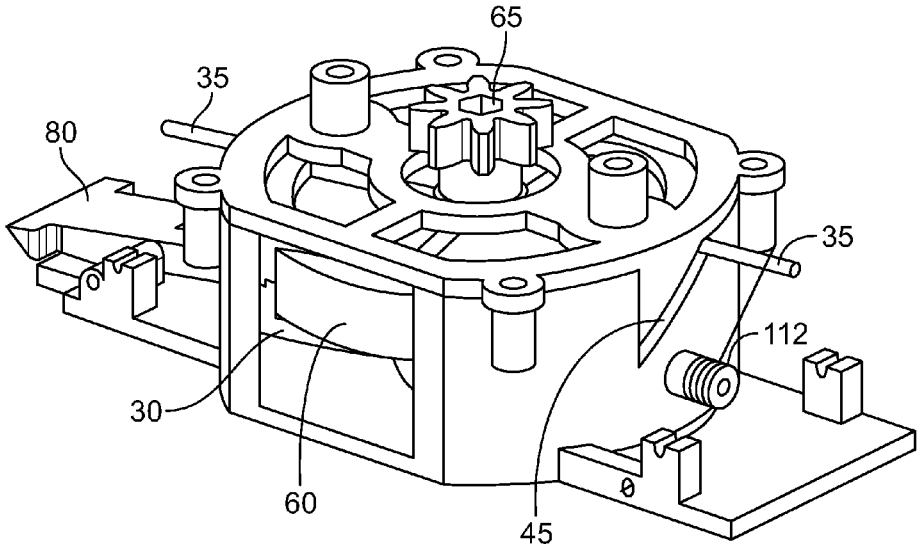
FIG. 3*f* is a rear perspective view of FIG. 3*a;*
Figure 4A:
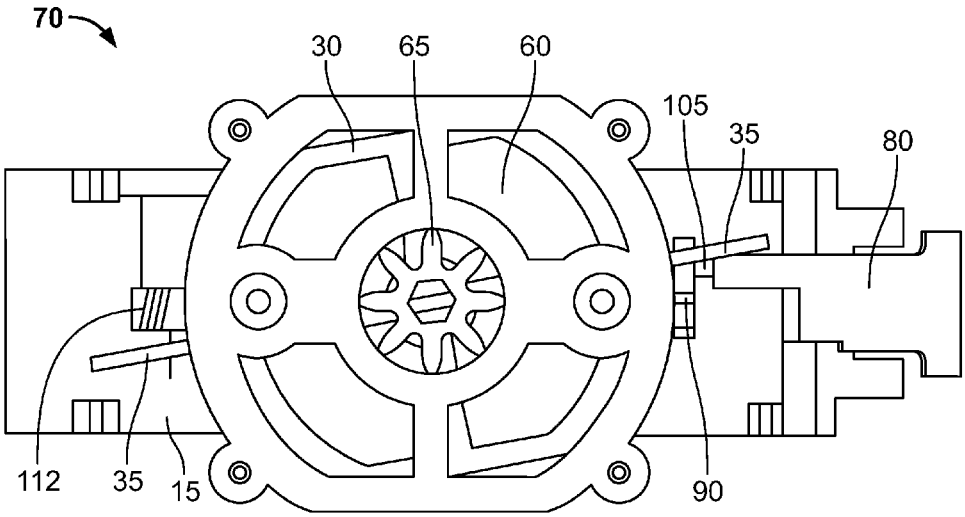
FIG. 4*a* is a top view of FIG. 3*a;*
Figure 4B:
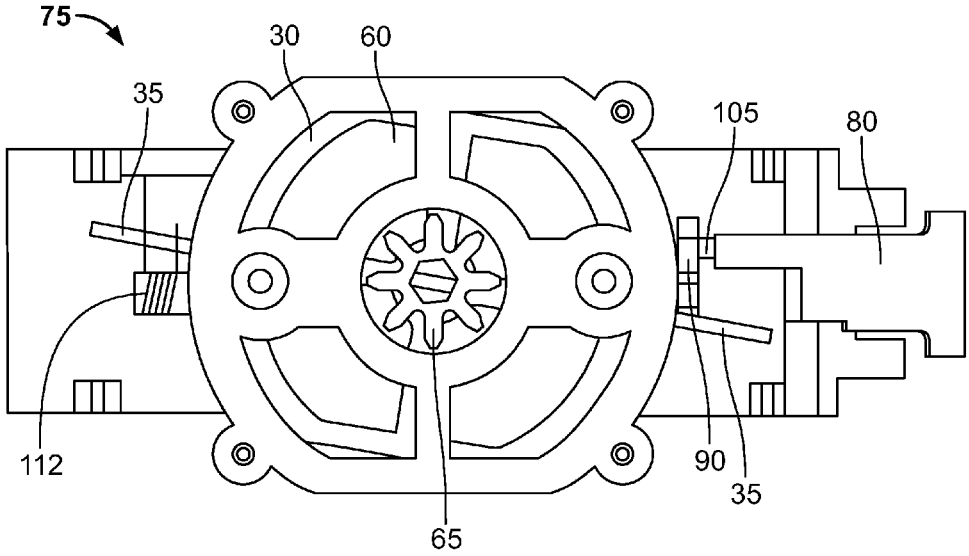
FIG. 4*b* is a top view of FIG. 3*c;*

Referring now again to FIGS. 2*a*-2*d* and 3*a*-3*f*, an exemplary flywheel 60 may be positioned within the flywheel housing 30. The flywheel 60 includes the spin shaft 40 fixed at and extending through the center of the flywheel 60 such that the flywheel 60 and spin shaft 40 spin simultaneously. An exemplary transfer gear 65 is positioned on the spin shaft 40 above the flywheel 60 and the upper clutch cone 55 is positioned below the flywheel 60 on the spin shaft 40. Alternative illustrative embodiments may adjust the positioning of the transfer gear 65 and upper clutch cone 55 relative to the flywheel 60, or the spin shaft 40 move independently as described in the example above. The two housing pins 35 are positioned within the two channels 45 to guide the path of the two housing pins 35. Thus guiding the flywheel housing 30 between at least a raised or first position 70 as shown in FIG. 3*a*, FIG. 3*f*, and FIG. 4*a* and a lowered or second position 75 as shown in FIG. 3*c*, FIG. 3*e*, and FIG. 4*b*. In one illustrative example of the capability to raise and lower the spin mechanism, a triggering capability may direct the flywheel housing 30 to move between each position. Position 70 may further be defined by the two housing pins 35 positioning in an upper portion of the two channels 45 such that a lower portion of the spin shaft 40 does not clear the wheels 20 and is not in contact with a surface. In first position 70, the flywheel 60 may spin substantially freely when energized (described further below). Position 75 may further be defined by the two housing pins 35 positioning in a lower portion of the two channels 45 such that the spin shaft 40 clears the wheels 20 and lifts the vehicle 10 off of the surface. Additionally, the upper clutch cone 55 engages the lower clutch cone 50 to transfer energy from the flywheel 60 to the chassis 15. In this position 75, the flywheel 60 and chassis 15 spin simultaneously on the spin shaft 40 when the flywheel 60 is energized.

As mentioned, the illustrative triggering capability may direct the flywheel housing 30 to move upward and/or downward between position 70 and position 75. Continuing to refer to FIGS. 3*a*-3*f* and FIGS. 4*a* and 4*b*, the triggering capability includes a release 80 pivotally attached to the chassis 15 about an axis 85, a linkage 90, channel 95 and guide 100. The release 80 may be in mechanical communication with the linkage 90 via release pin 105 and linkage aperture 110. The linkage 90 moves up and/or down as the release 80 pivots about the axis 85 in accordance with the guide 100 positioned within the channel 95. The linkage 90 holds the housing pin 35 in place against the bias of a torsion spring 112 when the flywheel housing 30 is in the position 70. Pivoting the release 80 upward releases the linkage 90 to move downwardly and as such, the bias of the torsion spring 112 pushes the housing pin 35 down the channel 45 to the position 75 as shown in FIGS. 3*c* and 3*e*.

Various energy generators are available to power the spinning movement of the vehicle 10. As one illustrative example, a gear rack 115 and a gear rack channel 120 to facilitate mechanical communication between the gear rack 115 and transfer gear 65. One example of a gear rack is a zip strip further defined as a gear rack with a handle. The gear rack 115 is inserted into the gear rack channel 120 such that the gear rack 115 meshes with the transfer gear 65. By removing the gear rack 115 from the gear rack channel 120, the gear rack 115 rotates the transfer gear 65 and as such energizes the flywheel 60 to spin the vehicle 10 on the spin shaft 40 when the clutch is engaged and the spin mechanism is in position 75. Varying the removal speed of the gear rack 115 may increase or decrease the rate at which the transfer gear 65 and flywheel spin 60, accordingly. Additionally, the gear rack channel 120 positioning may vary in accordance with the positioning of the transfer gear 65.

Figure 5A:
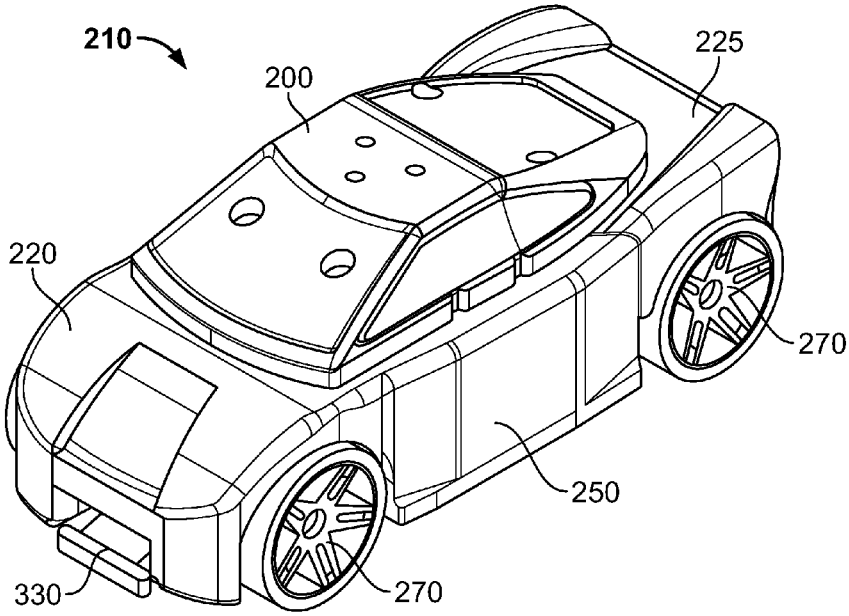
FIG. 5*a* is a perspective view of another illustrative vehicle in a first configuration.
Figure 5B:
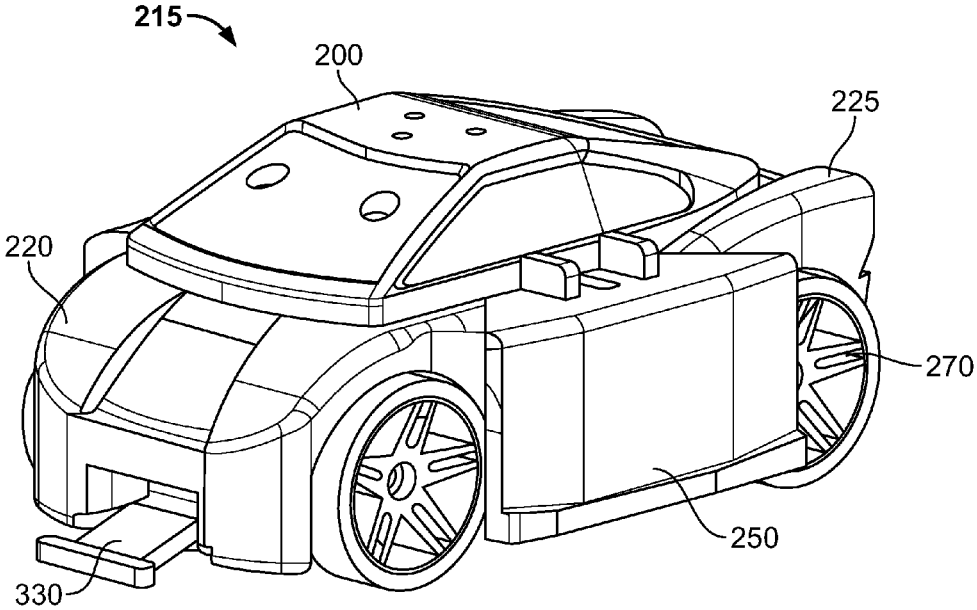
FIG. 5*b* is a perspective view of the vehicle from FIG. 5*a* in a second configuration.
Figure 5D:
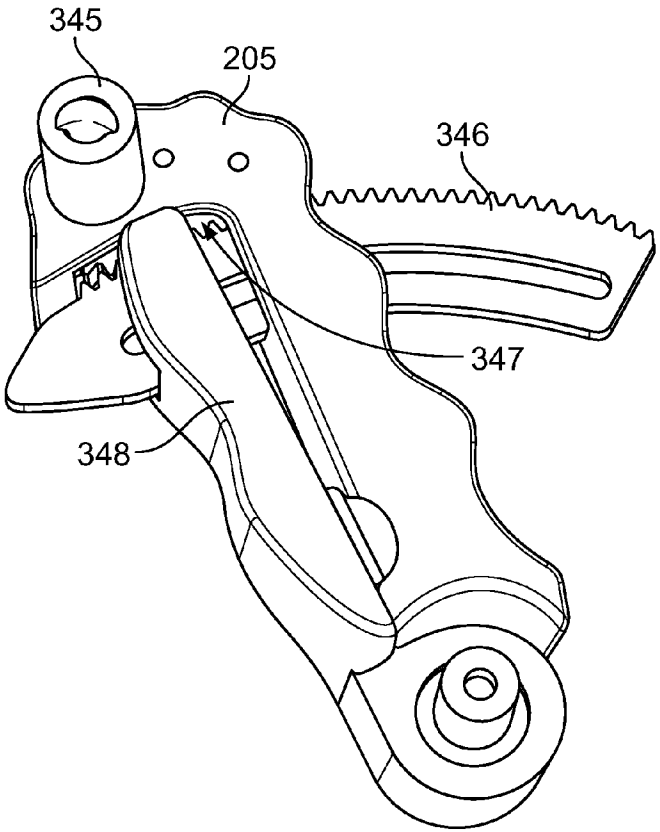
FIG. 5*d* is a perspective view of FIG. 5*c* where a handle of an illustrative launch mechanism is in a second position.
Figure 5C:
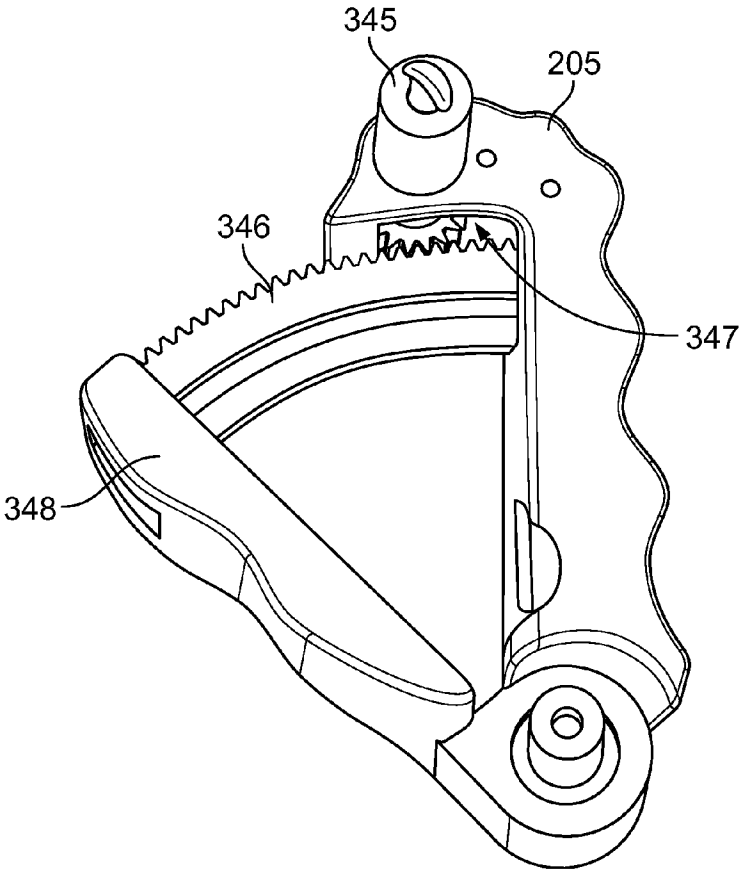
FIG. 5*c* is perspective view of an illustrative launch mechanism for use with the vehicle from FIG. 5*a* and FIG. 5*b* where a handle of the launch mechanism is in a first position.
Figure 6A:
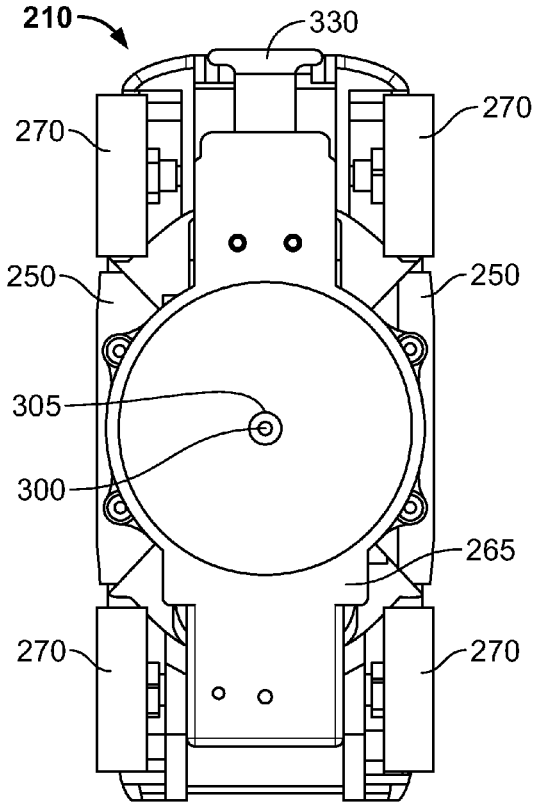
FIG. 6*a* is a bottom view of FIG. 5*a;*
Figure 6B:
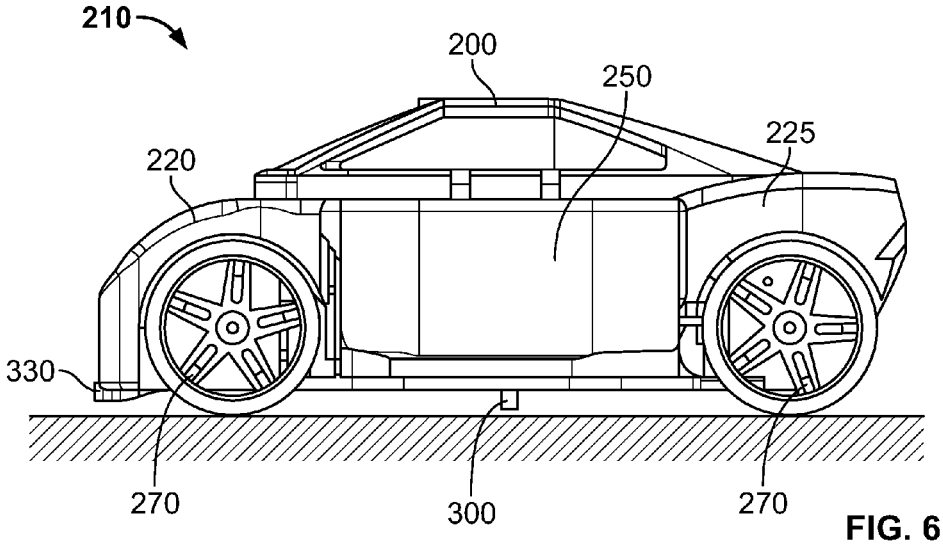
FIG. 6*b* is a side view of FIG. 5*a;*
Figure 6C:
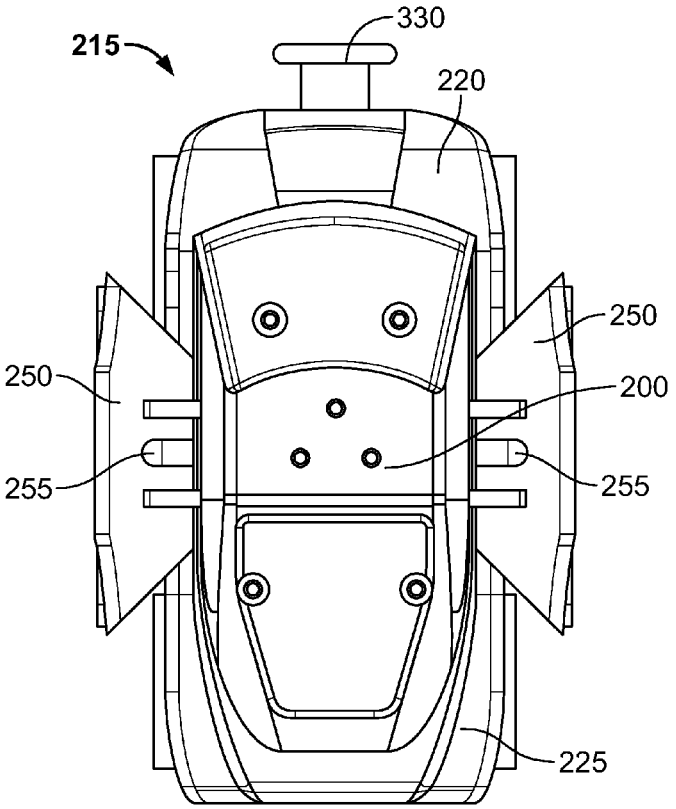
FIG. 6*c* is a top view of FIG. 5*b;*
Figure 6D:
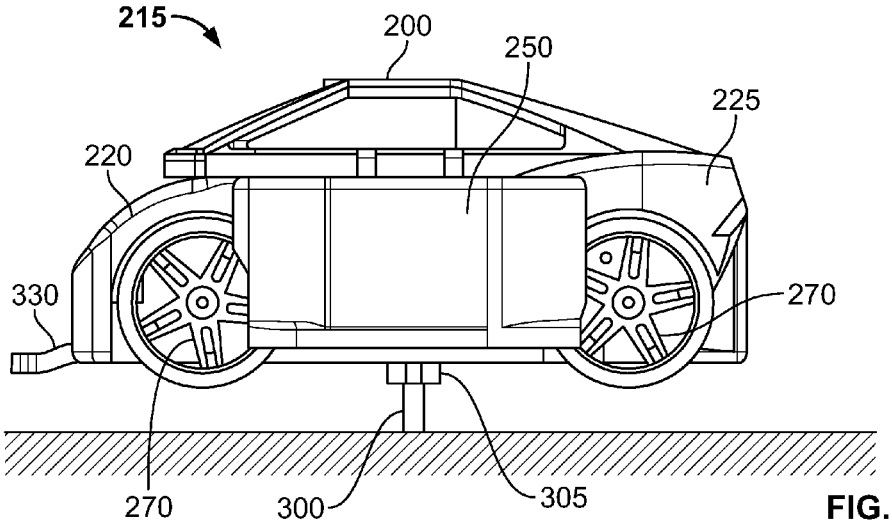
FIG. 6*d* is a side view of FIG. 5*b;*
Figure 7A:
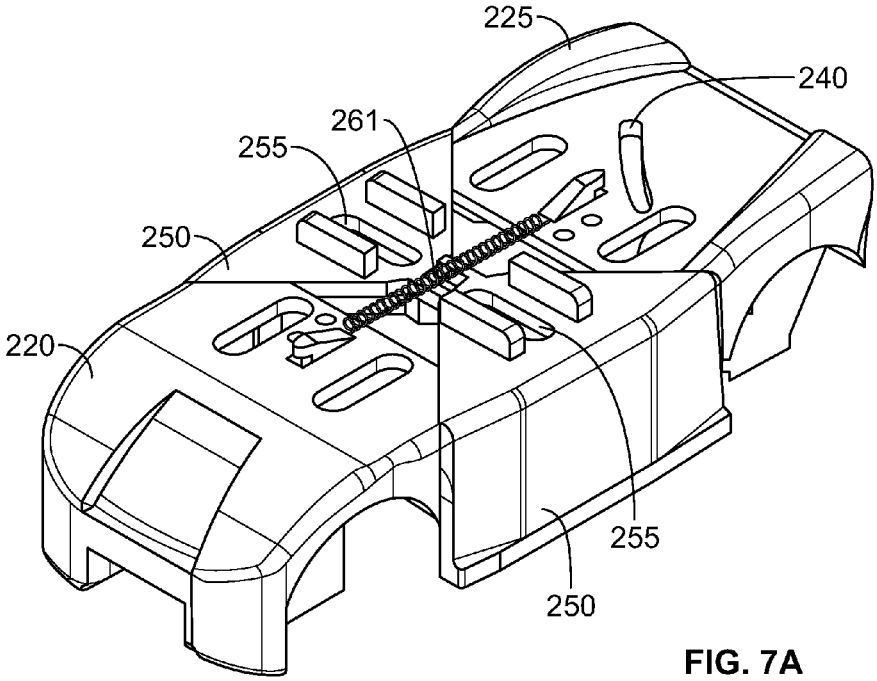
FIG. 7*a* is a perspective view of an illustrative front segment, rear segment, and two side segments in a first configuration.
Figure 7B:
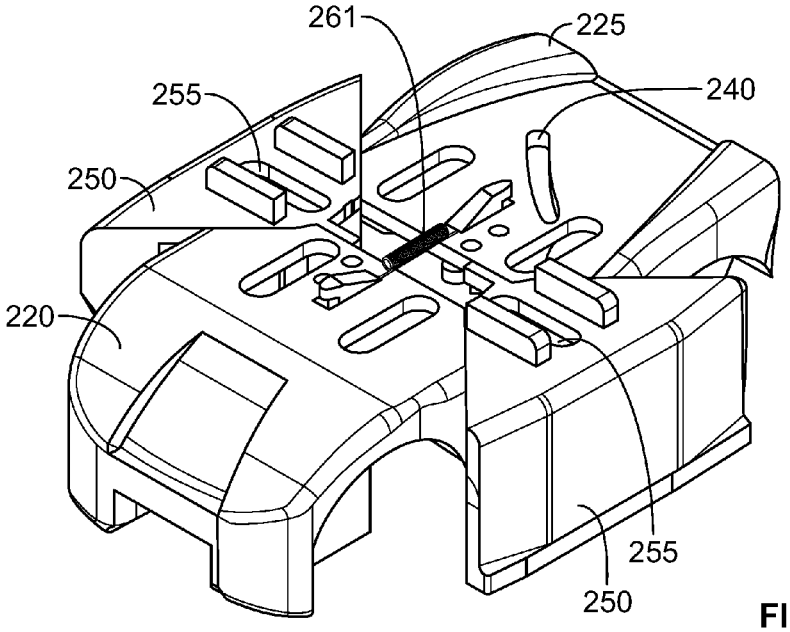
FIG. 7*b* is a perspective view of an illustrative front segment, rear segment, and two side segments in a second configuration.
Figure 7C:
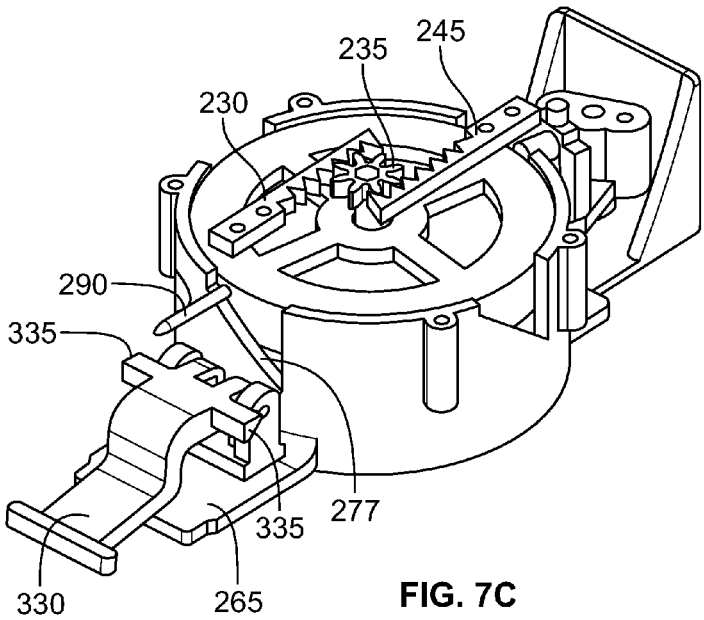
FIG. 7*c* is a perspective view of the vehicle from FIG. 5*a* with portions of the vehicle removed to show an illustrative chassis and internal mechanics of the vehicle.
Figure 7D:
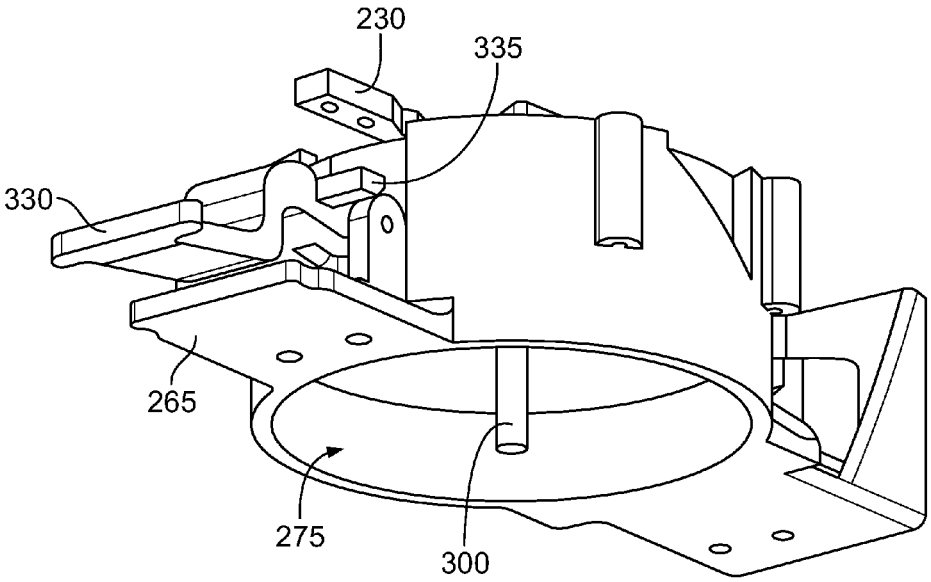
FIG. 7*d* is a lower perspective view of the vehicle from FIG. 5*a* with portions of the vehicle removed to show an illustrative chassis and internal mechanics of the vehicle.
Figure 7E:
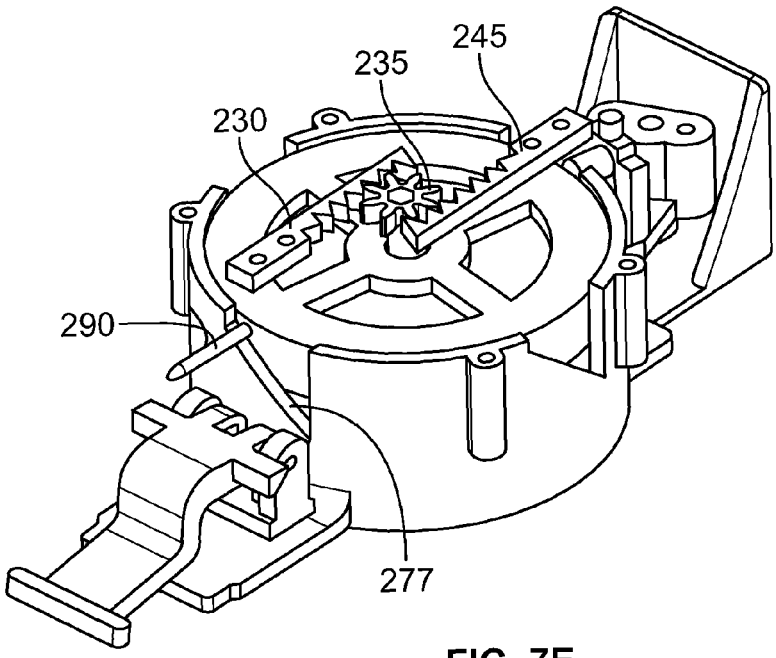
FIG. 7*e* is a perspective view of the vehicle from 5*a* with portions of the vehicle housing removed to show an illustrative chassis and internal mechanics of the vehicle.
Figure 7F:
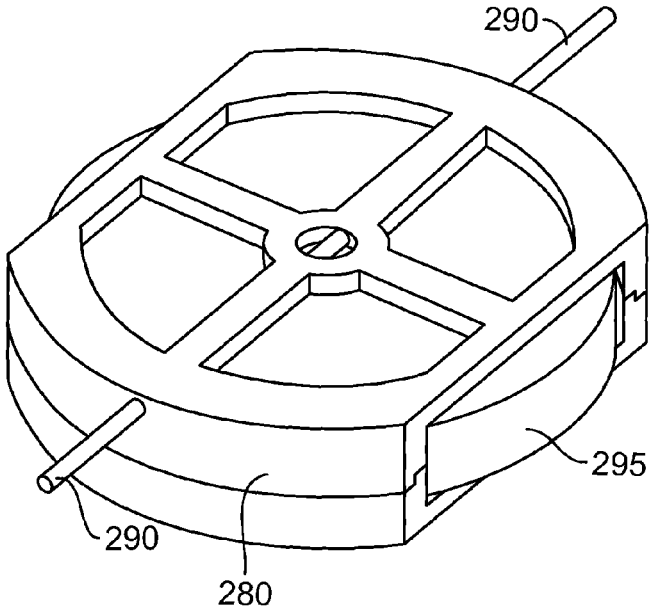
FIG. 7*f* is a perspective view of a portion of an illustrative spin mechanism included in the vehicle from FIG. 5*a;*
Figure 7G:
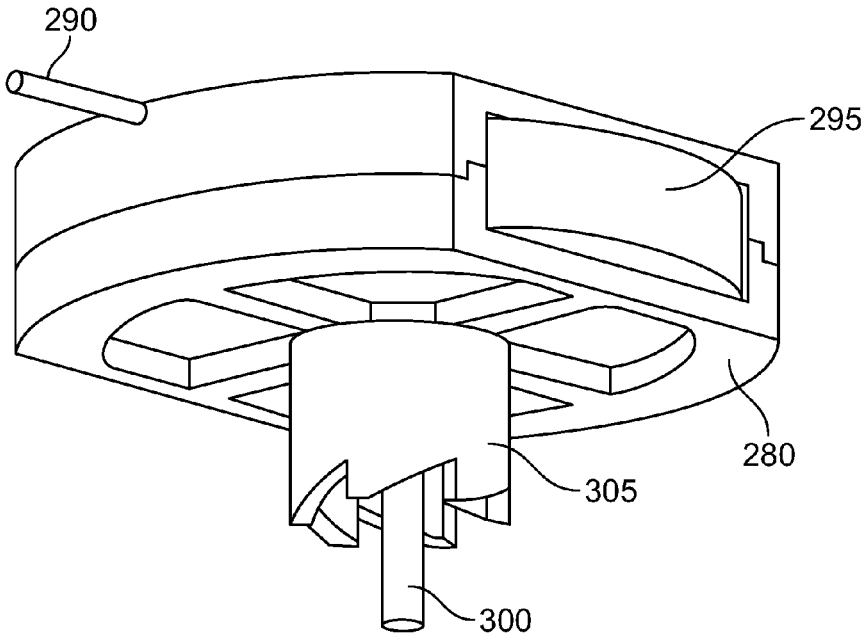
FIG. 7*g* is a lower perspective view of FIG. 7*f;*
Figure 7H:
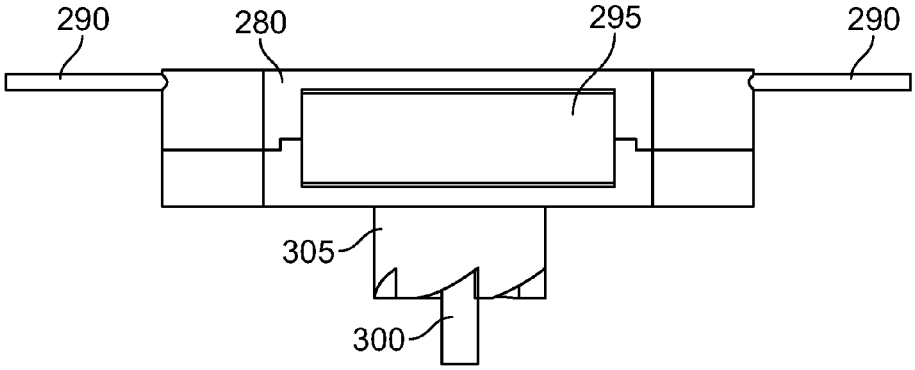
FIG. 7*h* is a side view of FIG. 7*f;*

Referring now to FIGS. 5*a*-6*d*, there is shown an exemplary transforming vehicle 200 and an example of a launch mechanism 205 in accordance with another illustrative embodiment. The vehicle 200 may include a capability and/or means to transform between a plurality of configurations including at least a first configuration 210 as shown in FIG. 5*a* and a second configuration 215 as shown in FIG. 5*b*. In the first configuration 210 the vehicle 200 is in the form of a car, however, the vehicle 200 may take on several different forms, including but not limited to other types of cars, planes, or spaceships. A variety of vehicle forms may be used to incorporate the internal mechanics of the vehicle 200 and launch mechanism 205. The vehicle 200 may also include a capability to raise and lower a spin mechanism to execute spinning top-like characteristics (described below) when the spin mechanism is charged, for example when charged by a power drive system within the launch mechanism 205 (described below).

Now additionally referring to FIGS. 7*a*-7*d*, the vehicle 200 may utilize a sliding movement of a front segment 220 and a rear segment 225 to direct the transformation from the first configuration 210 to the second configuration 215. The front segment 220 may include a front rack 230 secured thereto. The front rack 230 may be meshed with a central pinion 235 such that the front rack 230 guides lateral sliding movement of the front segment 220. The rear segment 225 may include a curved channel 240, and a rear rack 245 meshed with the central pinion 235. The rear rack 245 may be secured to the rear segment 225 such that the rear rack 245 may guide lateral sliding movement of the rear segment 225. Sliding the front segment 220 and rear segment 225 toward the central pinion 235 may direct the transformation of the vehicle 200 from the first configuration 210 to the second configuration 215 as the front segment 220 and rear segment 225 push two side segments 250 outward. Additionally, pushing the two side segments 250 outward may direct the spin mechanisms downward to lower a spin shaft as further described below.

The two side segments 250 may each include a side channel 255 to receive side pins (not shown) to guide lateral movement of the side segments 250. Optionally, a spring 261 secured to front segment 220 and the rear segment 225 may utilize the bias of the spring to pull the front segment 220 and rear segment 225 toward the central pinion 235. An illustrative chassis 265 includes four wheels 270 rotatably attached thereto, however the number of wheels and positioning may vary. Additionally, the chassis 265 may include a cavity 275 to house the spin mechanism. The cavity 275 may include cavity channels 277 and the cavity 275 is sized to accommodate the upward and downward movement of the spin mechanism. Now additionally referring to FIGS. 7*e*-7*h*, the spin mechanism may include a flywheel housing 280, cavity channels 277 to receive flywheel housing pins 290 extending from the flywheel housing 280, and a flywheel 295 with a spin shaft 300. The flywheel 295 may be positioned within the flywheel housing 280 and may include the spin shaft 300 extending from the center of the flywheel 295 such that the flywheel 295 and spin shaft 300 spin simultaneously and independently of the flywheel housing 280 when the friction clutch is in a raised position 306. Spin shaft 300 may include a transfer fixture 305 positioned below the flywheel 295 (though positioning of the transfer gear may vary depending on the type of launch mechanism) to transfer energy to the vehicle 200 from an energy generator via a transfer of frictional forces between the surface of the flywheel 295 and flywheel housing 280 when in a lowered position 307 to further define operation of the friction clutch.

Now additionally referring to FIGS. 8*a*-8*f*, the capability to raise and lower the spin mechanism may include an engagement mechanism to direct the upward and downward movement of the spin mechanism between at least the raised position 306 in the first configuration 210 and the lowered position 307 in the second configuration 215. The engagement mechanism may include a first linkage 310 rotatably attached to the chassis 265 with a second linkage 315 rotatably attached to the first linkage 310. The second linkage 315 including a channel 320 to receive one of the flywheel housing pins 290 and a guide pin 325 positioned within the curved channel 240 of the rear segment 225. As the front segment 220 and rear segment 225 are moved toward the central pinion 235, the two side segments 250 are pushed outward while the curved channel 240 guides the guide pin 325 of the engagement mechanism to direct the flywheel housing pin 290 downward along the according cavity channel 277 via the mechanical relationship between the components of the engagement mechanism. As such, the spin mechanism may lower to extend the spin shaft 300 below the depth of the wheels 270, engages the chassis via the friction clutch, and raises the vehicle 200 off of a surface to enable the vehicle 200 to spin on the spin shaft 300 when the flywheel 295 is energized. In another example of a spin mechanism, a spin shaft may extend through the center of the flywheel and chassis such that the spin shaft is disengaged from the chassis and flywheel when raised, and engages the chassis and flywheel when lowered via the friction clutch.

Figure 8A:
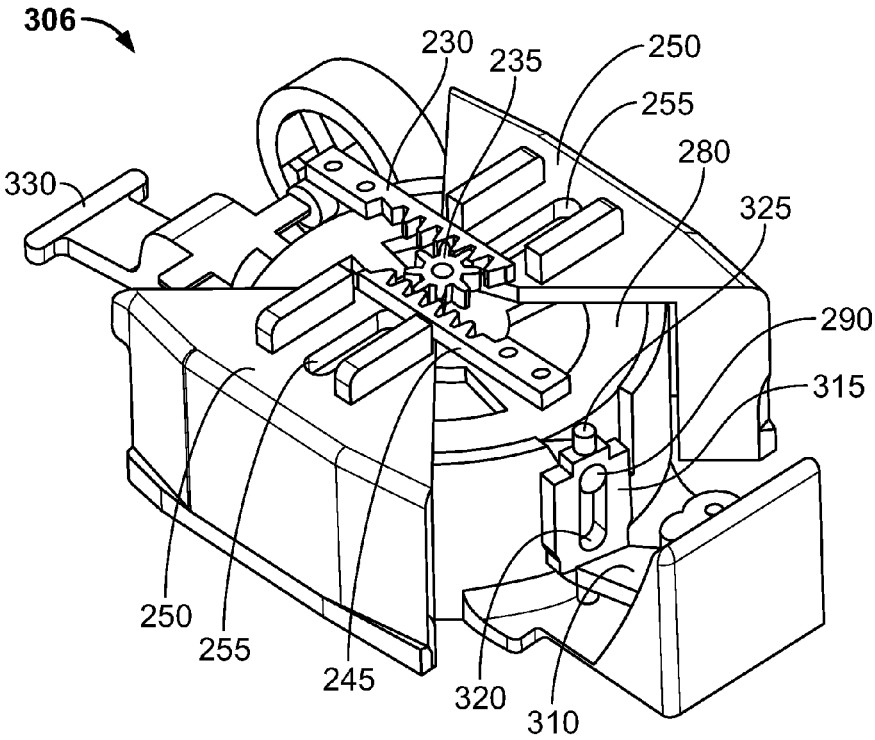
FIG. 8*a* is a perspective view of FIG. 5*a* with portions of the vehicle removed to show the spin mechanism in the raised position.
Figure 8B:
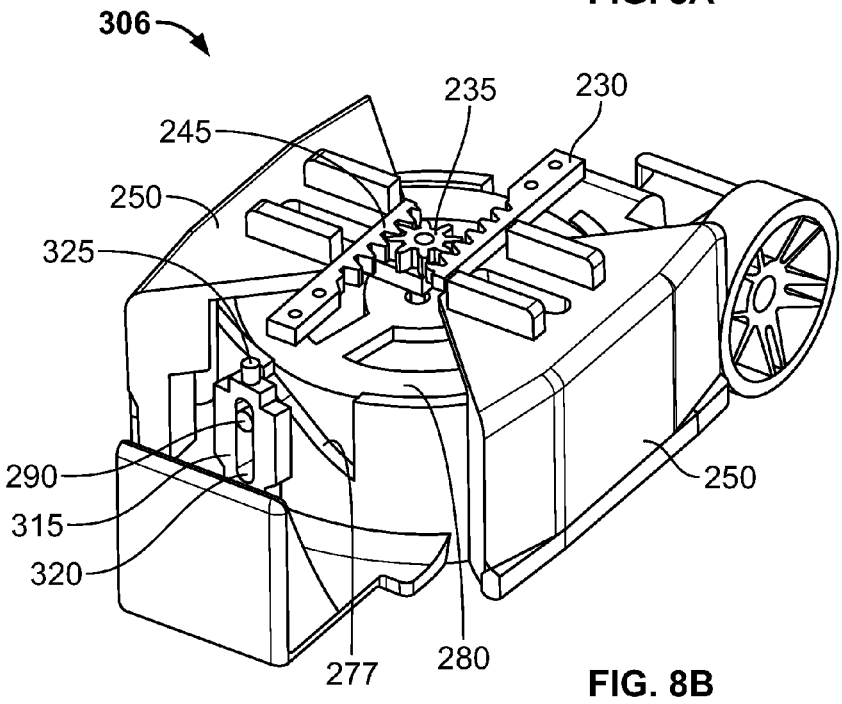
FIG. 8*b* is a reflective perspective view of FIG. 8*a;*
Figure 8C:
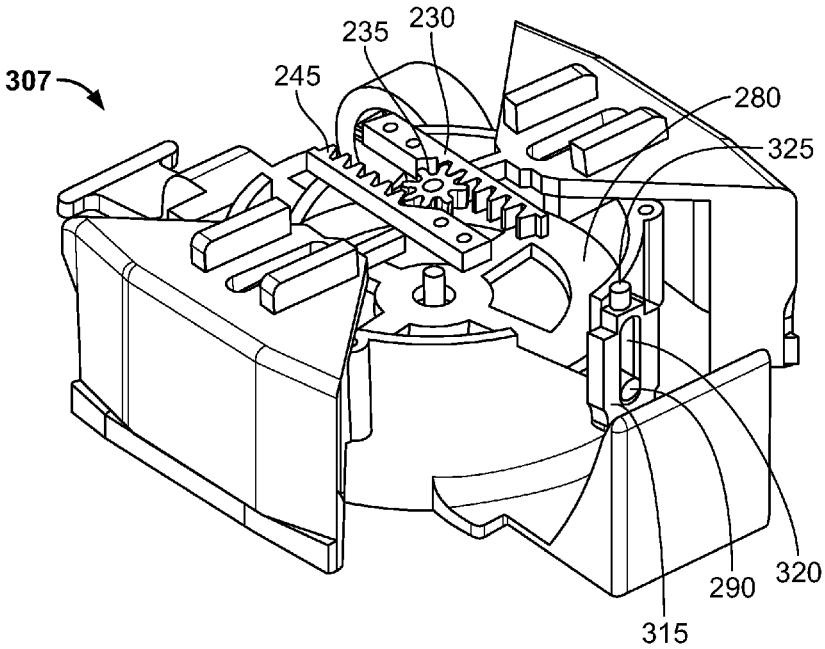
FIG. 8*c* is a perspective view of FIG. 5*b* with portions of the vehicle removed to show the spin mechanism in a lowered position.
Figure 8D:
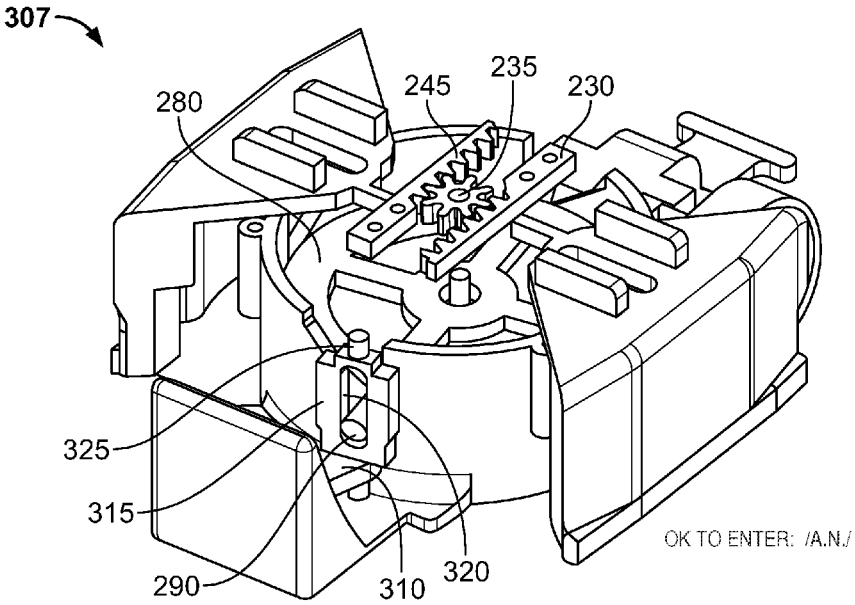
FIG. 8*d* is a reflective perspective view of FIG. 8*c;*
Figure 8E:
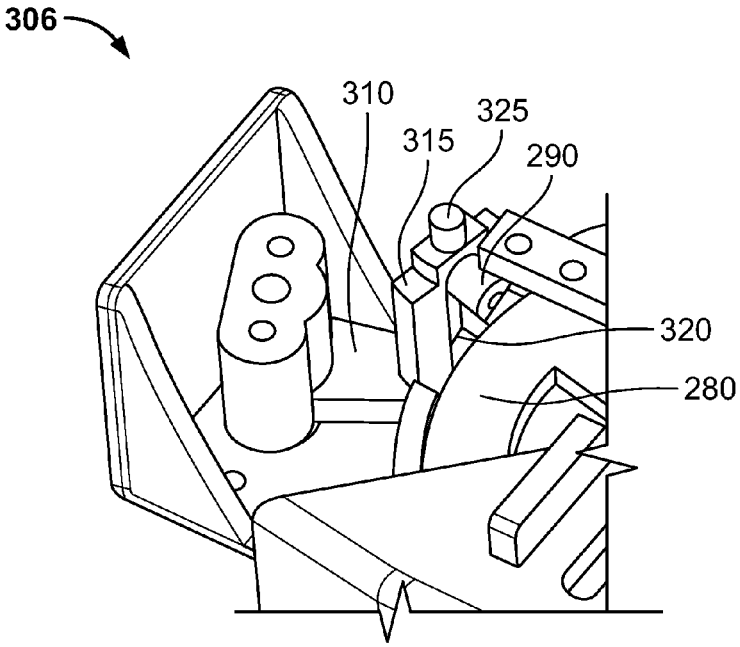
FIG. 8*e* is an enlarged perspective view of an illustrative spin mechanism in a raised position.
Figure 8F:
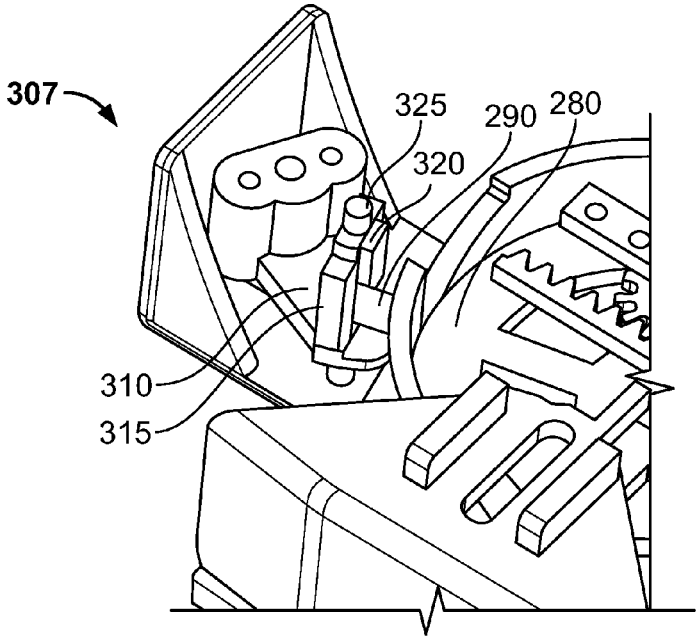
FIG. 8*f* is an enlarged perspective view of an illustrative spin mechanism in a lowered position.
Figure 8G:
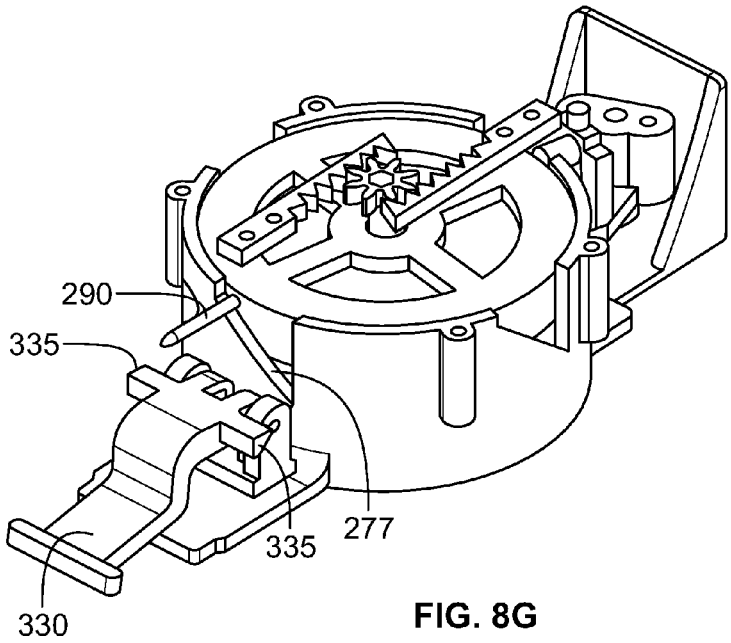
FIG. 8*g* is FIG. 7*e;*
Figure 8H:
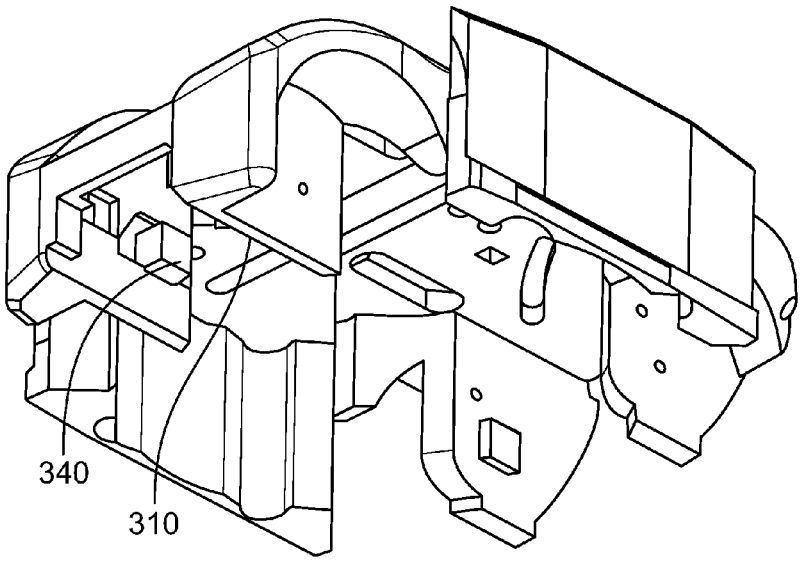
FIG. 8*h* is a lower perspective view of an illustrative front segment, rear segment, and two side segments.

Now referring to FIGS. 8*g* and 8*h* and again to FIGS. 7*a* and 7*b*, in one example of the capability to raise and lower the spin mechanism, a release mechanism may trigger movement of the engagement mechanism to lower the spin mechanism from the raised position 306 to the lowered position 307 and in accordance with a transformation from the first configuration 210 to the second configuration 215. The release mechanism may include a release 330 pivotally attached to the chassis 265 and may include latching wedges 335 to engage corresponding anchor wedges 340 on the front segment 220 to hold the vehicle in the first configuration 210. Pressing the release 330 disengages the latching wedges 335 and anchor wedges 340 such that a spring 261 pulls the front segment 220 and rear segment 225 toward the central pinion 235 while the spin mechanism is directed to move from the raised position 306 to the lowered position 307 as described above. The tension of spring 261 may hold the vehicle 200 in the second configuration 215. Pressing the two side segments 250 toward the central pinion 235 pushes the front segment 220 and rear segment 225 away from the central pinion 235, engaging the latching wedges 335 and anchor wedges 340 while moving the spin mechanism upward from the lowered position 307 to the raised position 306.

In another example of the capability to raise and lower the spin mechanism, a vertical spring (not shown) may be positioned on the spin shaft 300 either above or below the flywheel 295 to bias vertical movement of the spin mechanism.

Referring again to FIGS. 5*c*, 5*d*, 6*g*, and 6*h*, the transfer fixture 305 may be shaped to engage a launch fixture 345 and to facilitate a transfer of energy from the launch mechanism 205 to the vehicle 200. The launch mechanism 205 may accommodate many different energy generators including but not limited to power drive systems to generate, store and then release energy. The launch fixture 345 may transfer this energy to the vehicle 200 and may function with any number of power drive systems. In this illustrative example, the handheld launcher 205 includes a gear rack segment 346, gear train 347, handle 348 and launch fixture 345. Teeth on the rack 346 are meshed with the gear train 347 to drive rotation of the launch fixture 345 as the handle 348 moves inward to generate energy as the launch fixture 345 rotates and transfers energy to the vehicle 200 via the transfer fixture 305.

Referring now to FIGS. 9*a*-9*f*, an illustrative example of a game 400 includes at least two vehicles 405 which may include mechanics similar to vehicle 10 as described above. Each of the vehicles 405 may include a capability to raise and lower a spin mechanism between a plurality of positions, including a raised position and a lowered position when a trigger 410 is activated. The raised position may further be defined as a position where a spin shaft of the spin mechanism is above the plane of a set of wheels. The lowered position may further be defined as a position where the spin shaft extends below the plane of the set of wheels. In one illustrative example of game play, activating the trigger 410 on the vehicle 405 may direct the spin mechanism to lower to the lowered position. Further, the game 400 may include a plurality of directional implements such as cards or dice and a capability to incorporate a plurality of launch mechanisms, each with an energy generator. Varying numbers of vehicles 405, launch mechanisms and directional implements may be included in game play. Game play may occur on different types of surfaces such as an arena 415. When utilizing the arena 415, entry tracks 420 may be included to direct vehicle 405 travel from a launch position to the arena 415. Additionally, the tracks 420 may include a bump 425 to activate the trigger 410 and lower the spin mechanism to the lowered position for spinning and battle. Alternatively and when there is no bump 425 present, the trigger 410 may be activated when the vehicles 405 collide or when a vehicle 405 collides with an obstacle.

Figure 9A:
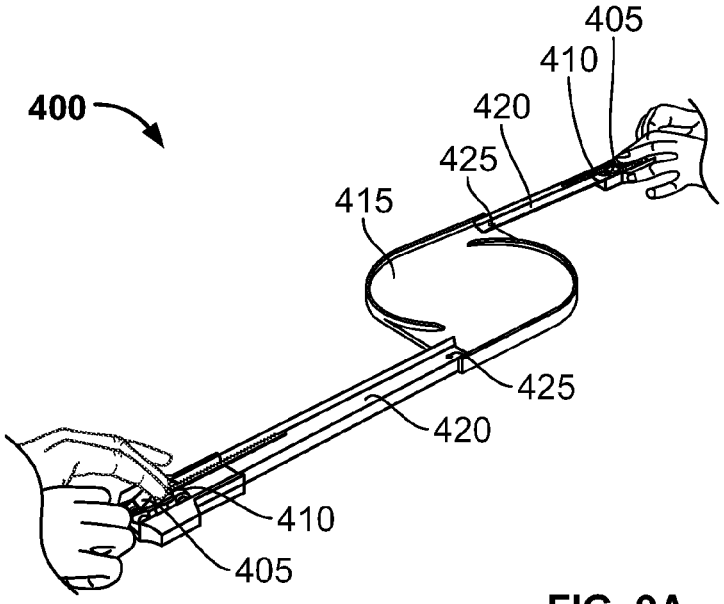
FIG. 9*a* is a perspective view of an illustrative game.
Figure 9B:
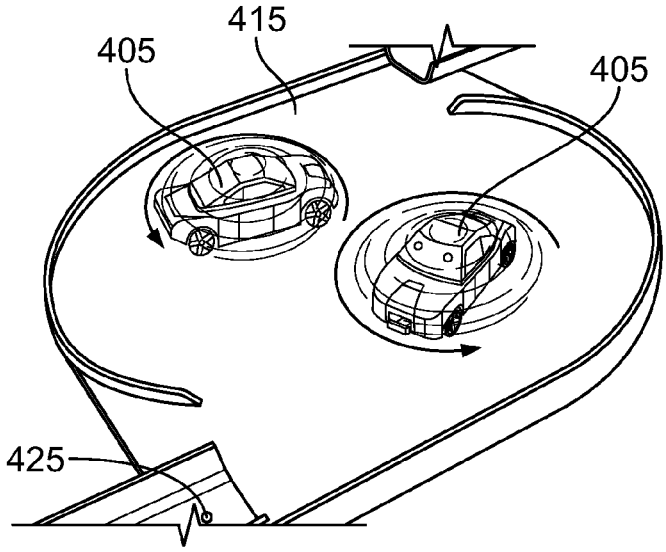
FIG. 9*b* is a perspective view of an illustrative stage of the game from FIG. 9*a;*
Figure 9C:
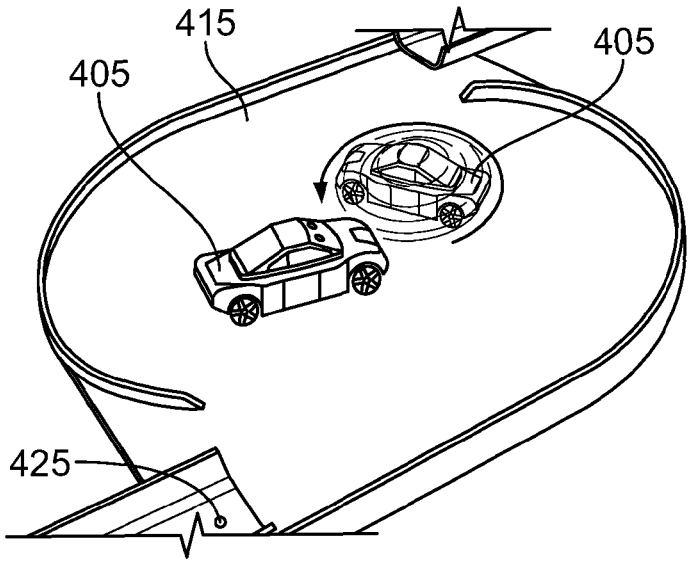
FIG. 9*c* is a perspective view of an illustrative stage of the game from FIG. 9*a;*
Figure 9D:
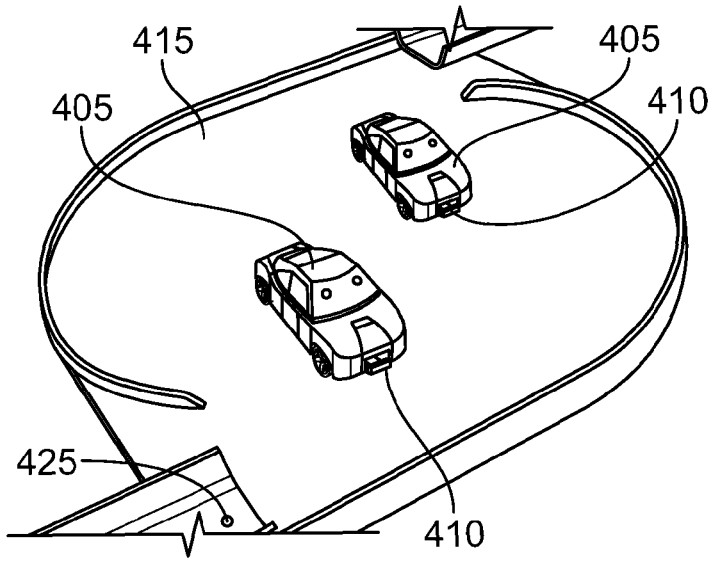
FIG. 9*d* is a perspective view of an illustrative stage of the game from FIG. 9*a;*
Figure 9E:
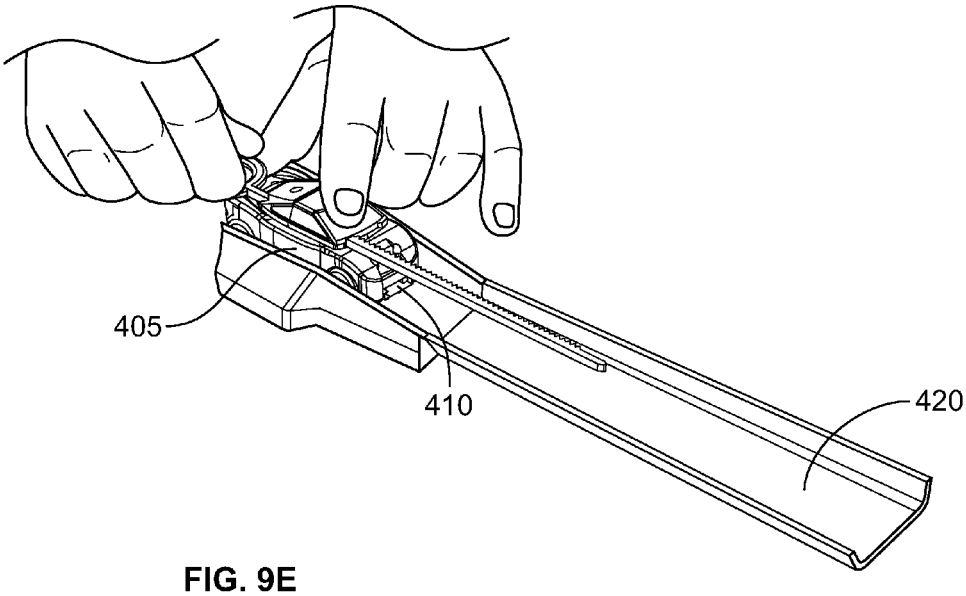
FIG. 9*e* is a perspective view of another illustrative setup for a game.
Figure 9F:
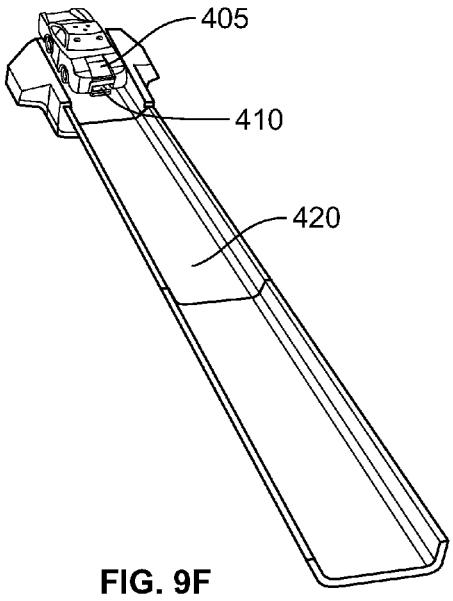
FIG. 9*f* is a front perspective view of FIG. 9*e;*

In one example of game play for two or more players, the object is for each player to acquire points by winning rounds of "battle" between vehicles. The first player to obtain a predetermined number of points wins. To start play, each player positions their vehicle 405 in the launch position as shown in FIG. 9*a*. The players pull racks to charge the spin mechanisms, and then launch the vehicles 405 down the tracks 420, hitting the bumps 425 to activate the trigger 410 to lower each vehicle's 405 spin mechanism from the raised position to the lowered position such that the vehicles spin. FIG. 9*b* shows the vehicles 405 spinning in the lowered positions within the arena 415. FIG. 9*c* shows the vehicles 405 colliding. FIG. 9*d* shows one of the vehicles 405 at rest following the collision while the other vehicle continues to spin and thus, wins the round. The collision may trigger varying outcomes such as one or more of the vehicles 405 spinning out of the arena 415, or one or more of the vehicles 405 may stop spinning altogether. Game play may also occur on a table top or floor when using a launch position and track 420 as shown in FIGS. 9*e* and 9*f*.

Figure 10A:
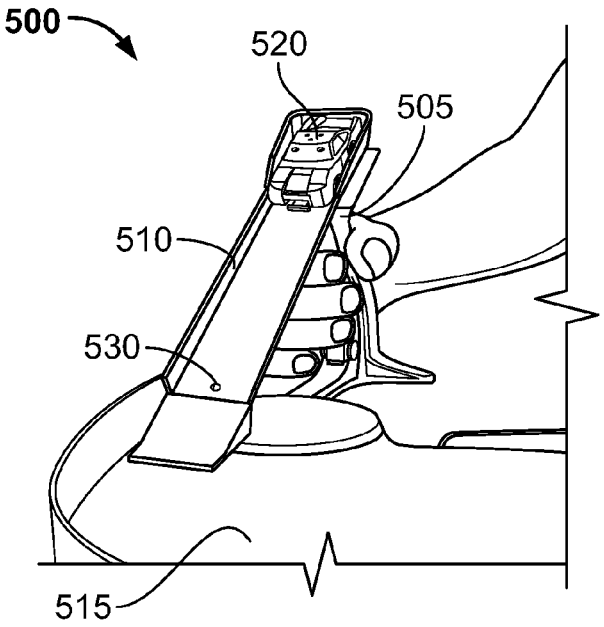
FIG. 10*a* is a perspective view of another illustrative game.
Figure 10B:
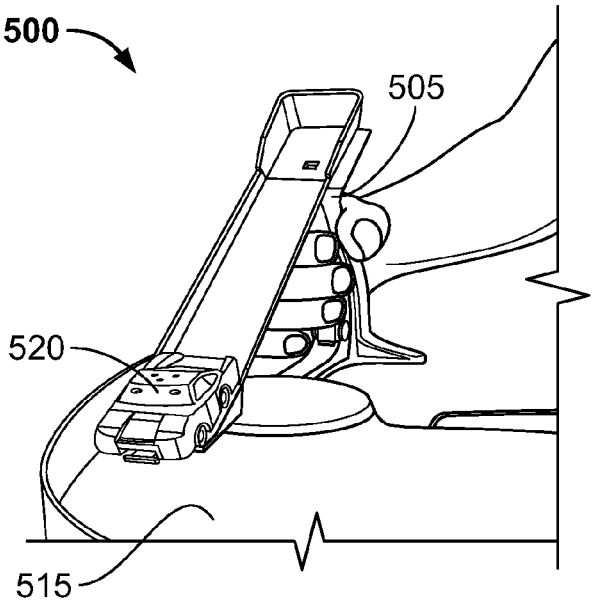
FIG. 10*b* is a perspective view of an illustrative stage of the game from FIG. 10*a;*
Figure 10C:
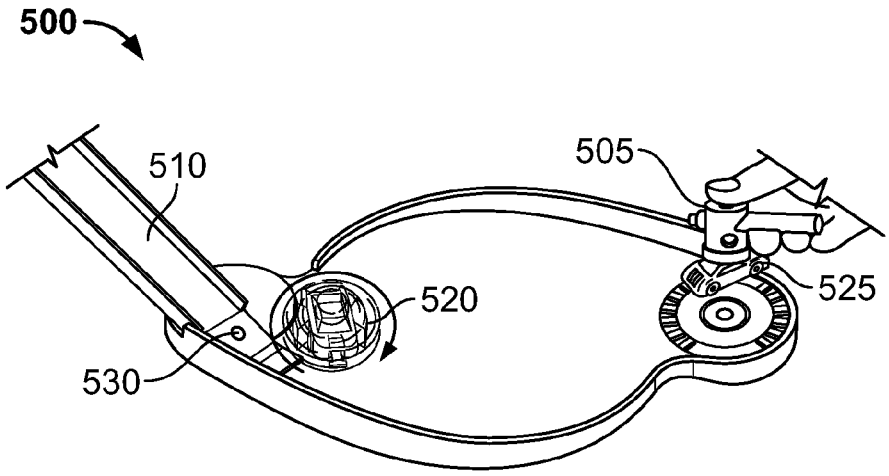
FIG. 10*c* is a perspective view of an illustrative stage of the game from FIG. 10*a;*
Figure 10D:
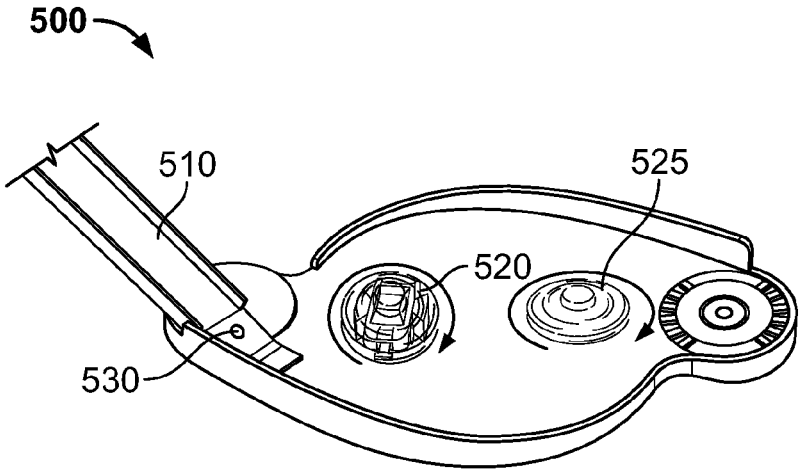
FIG. 10*d* is a perspective view of an illustrative stage of the game from FIG. 10*a;*
Figure 10E:
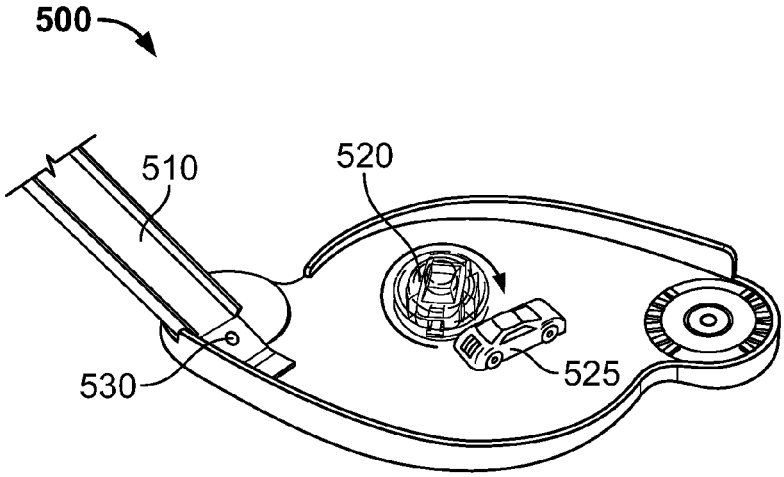
FIG. 10*e* is a perspective view of an illustrative stage of the game from FIG. 10*a*.
Figure 10F:
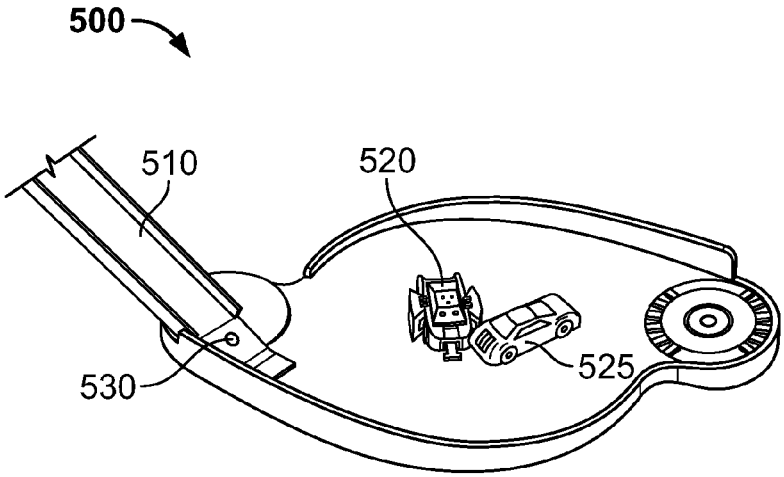
FIG. 10*f* is a perspective view of an illustrative stage of the game from FIG. 10*a.*

In yet another illustrative embodiment as shown in FIGS. 10*a*-10*b*, a game 500 may include launch mechanisms 505, entry tracks 510 and an arena 515. In this illustrative embodiment, vehicle 520 and vehicle 525 have the capability to transform between a first configuration and a second configuration, for example having similar mechanics included in vehicle 200 described above. A collision may direct one or more of the vehicles to transform between configurations, or one or more of the vehicles may remain in a configuration. Vehicle 520 may start in an elevated position in the first configuration and vehicle 525 may start in a lower position in the second configuration. Each player charges their respective launch mechanism 505 and then simultaneously presses a release button on their respective launch mechanisms 505 to launch the vehicles. Vehicle 505 travels down track 510, hitting a bump 530 to trigger a release 531 to transform from the first configuration to the second configuration as shown in FIG. 10*b*. The vehicles spin toward one another for a collision and/or battle as shown in FIG. 10*d*. FIGS. 10*e* and 10*f* show a collision where vehicle 525 is knocked back into the first configuration and vehicle 520 remains in the second configuration thus winning the round.

There are many play patterns that can be included in the game play with different types of launch mechanisms, vehicle embodiments, and playing surfaces. The examples above are meant to be but two of the many and not meant to limit the invention in any manner.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

We claim:

1. A vehicle with spinning capabilities comprising:

a chassis with a cavity to accommodate a spin mechanism;

at least two wheels rotatably attached to the chassis;

the spin mechanism including a flywheel housing, a flywheel with a transfer gear, and a spin shaft extending from the center of the flywheel with a clutch to engage the chassis and flywheel to transfer energy from the flywheel to the chassis;

a capability to raise and lower the spin mechanism within the cavity between at least a raised position and a lowered position, the lowered position further defined by the spin shaft lowering to lift the vehicle off of a surface, and such that the clutch engages the flywheel and chassis to spin simultaneously on the spin shaft when the flywheel is energized;

a trigger to direct the capability to raise and lower the spin mechanism to lower the spin mechanism to the lowered position an energy generator in communication with the transfer gear, wherein energy transferred from the energy generator spins the spin shaft and flywheel via the transfer gear, and a first activation of the trigger lowers the flywheel and spin shaft to the lowered position to lift the vehicle off of the surface and engages the clutch such that the flywheel and chassis spin simultaneously on the spin shaft.

2. The vehicle of claim 1, the capability to raise and lower the spin mechanism further comprising:

the flywheel housing including two flywheel housing pins extending therefrom;

the cavity including two channels to receive and guide movement of the two flywheel housing pins and the flywheel housing between the raised position and the lowered position;

a spring secured to the chassis and positioned to bias movement of one of the flywheel housing pins downward in one of the two channels;

the clutch including a lower clutch cone on the chassis and an upper clutch cone on the spin shaft;

wherein the triggering capability holds the flywheel housing in the raised position until the trigger releases the flywheel housing such that the flywheel housing lowers to the lowered position as the two flywheel housing pins travel down the two channels via the bias of the spring, and the flywheel housing moves to the raised position when the spin shaft is pushed upward as the two flywheel housing pins travel up the two channels against the bias of the spring.

3. The vehicle of claim 2, the triggering capability further comprising:

a release pivotally attached to the chassis;

a linkage within a linkage channel;

a guide secured to the cavity; and the release in mechanical communication with the linkage such that the linkage moves up and down as the release pivots and in accordance to the guide positioned within the linkage channel;

wherein the linkage holds one of the two pins in the raised position until the release pivots upward to release one of the two flywheel housing pins such that the torsion spring pushes the flywheel housing pin down one of the two channels to the lowered position.

4. The vehicle of claim 1, the vehicle further comprising:

the capability to raise and lower the spin mechanism further comprising:

the flywheel housing including two flywheel housing pins extending therefrom;

the cavity including two channels to receive and guide movement of the two flywheel housing pins and flywheel housing between the raised position and the lowered position;

a spring positioned on the spin shaft to bias vertical movement of the spin mechanism;

the triggering capability further comprising:

a release pivotally attached to the chassis;

a linkage within a linkage channel;

a guide secured to the cavity; and the release in mechanical communication with the linkage such that the linkage moves up and down as the release pivots in accordance to the guide positioned within the linkage channel;

wherein the linkage holds one of the two flywheel housing pins against the bias of the spring until the release pivots upward to release one of the two flywheel housing pins such that the spring pushes the flywheel housing pin in the direction of the spring's bias.

5. The vehicle of claim 1, the energy generator further comprising:

a gear rack channel on the vehicle aligned with the transfer gear such that a gear rack may mesh with the transfer gear when the gear rack is inserted into the gear rack channel;

wherein removal of the gear rack from the gear rack channel rotates the transfer gear to spin the vehicle on the spin shaft when the spin mechanism is in the lowered position.

6. The vehicle of claim 5 wherein the gear rack is a zip strip.

7. The vehicle of claim 1 further comprising:

the clutch further defined as a lower clutch cone on the chassis and an upper clutch cone on the spin shaft;

the energy generator including a hand held launcher with a transfer fixture positioned to mesh with the transfer gear, the hand held launcher further including a handle, a gear segment rack and a power drive system that charges when the handle moves the gear segment rack; and wherein the transfer fixture on the hand held launcher transfers energy from the charged power drive system to the transfer gear when the transfer gear and transfer fixture are meshed to spin the flywheel, spin shaft, and vehicle when the upper clutch cone and the lower clutch cone are engaged.

8. A transforming vehicle and launch system comprising:

a vehicle with a chassis, a sliding front segment, a sliding rear segment, two sliding side segments and a capability to transform between multiple configurations including a first configuration and a second configuration, wherein movement of the front segment and rear segment toward one another pushes the two sliding side segments outward to further define the second configuration;

the chassis including at least two wheels rotatably attached thereto and a cavity to accommodate a spin mechanism;

the spin mechanism including a flywheel housing, a flywheel with a transfer gear, a spin shaft extending from the center of the flywheel and a friction clutch to transfer energy from the flywheel to the flywheel housing and chassis;

a capability to raise and lower the spin mechanism within the cavity in accordance with the first configuration and the second configuration, respectively, the second configuration further defined by the spin shaft lowering to lift the vehicle off of a surface, and such that the friction clutch engages the chassis and flywheel to spin simultaneously when the flywheel is energized;

a trigger to direct the spin mechanism to lower when the vehicle transforms from the first configuration to the second configuration; and an energy generator in communication with the transfer gear, wherein energy transferred to the transfer gear from the energy generator spins the flywheel and chassis when the friction clutch transfers energy from the flywheel to the chassis to spin the vehicle on the spin shaft in the second configuration.

9. The transforming vehicle and launch system of claim 8, the transformation capability further comprising:

the front segment including a front rack meshed with a central pinion on the vehicle chassis such that the front rack guides lateral movement of the front segment; and the rear segment including a rear rack meshed with the central pinion such that the rear rack guides lateral movement of the rear segment, the rear segment further including a curved channel to receive a guide pin included in the capability to raise and lower the spin mechanism such that the curved channel guides movement of the guide pin; and the two side segments each including a capability to guide lateral movement of the side segments;

wherein pressing the trigger transforms the vehicle from the first configuration to the second configuration when the front segment and rear segment move toward the central pinion, pushing the side segments outward as the curved channel guides movement of the guide pin to lower the spin mechanism such that the spin shaft lifts the vehicle off of the surface.

10. The transforming vehicle and launch system of claim 9, the capability to raise and lower the spin mechanism further comprising:

an engagement mechanism comprising:

a first linkage rotatably attached to the chassis and a second linkage rotatably attached to the first linkage;

the second linkage including the guide pin positioned within the curved channel, and a second linkage channel to receive a flywheel housing pin secured to the flywheel housing;

wherein as the rear segment moves toward or away from the central pinion, the curved channel guides movement of the guide pin and second linkage such that the second linkage channel guides the flywheel housing pin downward or upward between the raised position and the lowered position.

11. The transforming vehicle and launch system of claim 10, the trigger further comprising:

a release mechanism including a release pivotally attached to the chassis and including latching wedges to engage corresponding anchor wedges included on the front segment to hold the vehicle in the first configuration;

wherein pivoting the release upward disengages the latching wedges and anchor wedges such that a spring pulls the front segment and rear segment toward the central pinion and lowers the spin mechanism to the lowered position.

12. The transforming vehicle and launch system of claim 11, the release mechanism further comprising a spring positioned on the spin shaft to bias vertical movement of the spin mechanism within the cavity in accordance with upward and downward movement of the spin mechanism.

13. The transforming vehicle and launch system of claim 12, the energy generator further comprising:

the transfer gear positioned to communicate with a transfer fixture on a hand held launcher; and the energy generator further including a power drive system that charges when a handle of the hand held launcher moves and directs a rack to energize the power drive system;

wherein the transfer fixture on the hand held launcher transfers energy from the power drive system to rotate the transfer gear via the transfer fixture such that the spin shaft and vehicle spin simultaneously when the clutch is engaged.

14. A method of playing a game comprising:

providing at least two vehicles, each vehicle having spinning capabilities and comprising:

a chassis;

a spin mechanism including a spin shaft and a flywheel with a transfer gear;

an energy generator in communication with the transfer gear to energize the flywheel;

a friction clutch to engage the spin mechanism and chassis to transfer energy from the flywheel to the chassis;

a capability to raise and lower the spin mechanism between at least a first position and a second position, the second position further defined by the spin shaft lowering to lift the vehicle off of a surface, and such that the friction clutch engages the spin mechanism and chassis to spin simultaneously when the flywheel is energized;

providing an energy generator for each vehicle in communication with each respective transfer gear to transfer energy to the respective flywheel;

each player of a plurality of players selecting a vehicle and energy generator;

directing each player to set the spin mechanism to the first position;

directing each player to activate their energy generator to transfer energy to the spin mechanism via the transfer gear;

directing each player to launch their vehicles such that a trigger directs the capability to raise and lower the spin mechanism lowers the spin shaft to lift the vehicle off of the surface such that the vehicles spin on their respective spin shafts toward one another and collide;

awarding points to a player based on the result of the collision; and winning the game by obtaining a predetermined number of points.

15. The method of playing a game of claim 14 further comprising:

the surface further defined as an arena;

at least two entry tracks in communication with the arena, each entry track including a bump to activate the trigger to lower the spin mechanism;

directing each player to launch their vehicles such that the bump activates the trigger to lower the spin shaft to lift the vehicle off of the surface such that the vehicles spin on their respective spin shafts toward one another in the arena and collide.

16. The method of playing a game of claim 14, the energy generator further comprising:

the transfer gear positioned to communicate with a transfer fixture on a hand held launcher; and the energy generator further including a power drive system that charges when a handle of the hand held launcher moves and directs a rack to energize the power drive system;

wherein the transfer fixture on the hand held launcher transfers energy from the power drive system to rotate the transfer gear via the transfer fixture such that the spin shaft and vehicle spin simultaneously when the clutch is engaged.

17. The method of playing a game or claim 14 further comprising:

the vehicles including a gear rack channel on the vehicle aligned with the transfer gear such that a gear rack may mesh with the transfer gear when the gear rack is inserted into the gear rack channel to further define the energy generator;

wherein removal of the gear rack from the gear rack channel rotates the transfer gear to spin the vehicle on the spin shaft when the spin mechanism is in the lowered position.

18. A vehicle with spinning capabilities comprising:

a chassis with a cavity to accommodate a spin mechanism;

at least two wheels rotatably attached to the chassis;

the spin mechanism including a flywheel with a transfer gear;

a spin shaft extending through a center aperture of the flywheel, a center aperture of the transfer gear, and at least one aperture of the chassis;

a friction clutch to engage the flywheel and chassis to transfer energy from the flywheel to chassis;

a capability to raise and lower the spin shaft between at least a raised position and a lowered position, the lowered position further defined by the spin shaft lowering to lift the vehicle off of a surface, and such that the friction clutch engages the flywheel and chassis to spin simultaneously when the flywheel is energized;

a trigger to direct spin shaft movement between the raised position and lowered position; and an energy generator in communication with the transfer gear, wherein energy transferred from the energy generator spins the flywheel via the transfer gear, and a first activation of the trigger lowers the spin shaft to the lowered position such that friction forces engage the flywheel and chassis to spin the vehicle on the spin shaft.

19. The vehicle of claim 18, the energy generator further comprising:

a gear rack channel on the vehicle aligned with the transfer gear such that a gear rack meshes with the transfer gear when the gear rack is inserted into the gear rack channel; and wherein removal of the gear rack from the gear rack channel rotates the transfer gear to spin the flywheel and vehicle on the spin shaft when the spin shaft is in the lowered position and the friction clutch is engaged.

20. The vehicle of claim 19, wherein the gear rack is a zip strip.

21. The vehicle of claim 18 further comprising:

the transfer gear positioned to mesh with a transfer fixture on a hand held launcher;

the energy generator further comprising the hand held launcher with a power drive system that charges when a handle of the hand held launcher directs a rack to energize the power drive system; and wherein the transfer fixture on the hand held launcher transfers energy from the power drive system to the transfer gear when the transfer gear and transfer fixture are meshed to rotate the transfer gear.

* * * * *